US008287066B2

(12) United States Patent
Jackson et al.

(10) Patent No.: US 8,287,066 B2
(45) Date of Patent: Oct. 16, 2012

(54) INK JET PRINTING METHOD

(75) Inventors: Christian Jackson, Wilmington, DE (US); Stephen F. Pond, Williamsburg, VA (US)

(73) Assignee: E I du Pont de Nemours and Company, Wilmington, DE (US)

( * ) Notice: Subject to any disclaimer, the term of this patent is extended or adjusted under 35 U.S.C. 154(b) by 341 days.

(21) Appl. No.: 12/530,854

(22) PCT Filed: Mar. 14, 2008

(86) PCT No.: PCT/US2008/003469

§ 371 (c)(1),
(2), (4) Date: Sep. 11, 2009

(87) PCT Pub. No.: WO2008/112316

PCT Pub. Date: Sep. 18, 2008

(65) Prior Publication Data

US 2010/0091053 A1 Apr. 15, 2010

Related U.S. Application Data

(60) Provisional application No. 60/906,950, filed on Mar. 14, 2007.

(51) Int. Cl.
*B41J 29/38* (2006.01)
*B41J 29/393* (2006.01)
*B41J 2/165* (2006.01)

(52) U.S. Cl. ..... 347/9; 347/19; 347/34; 347/35; 347/36

(58) Field of Classification Search ..... 347/19, 347/34–36, 9–10
See application file for complete search history.

(56) References Cited

U.S. PATENT DOCUMENTS

| | | | | |
|---|---|---|---|---|
| 6,533,382 | B1 * | 3/2003 | Tomida et al. | 347/15 |
| 2006/0119669 | A1 * | 6/2006 | Sharma et al. | 347/82 |
| 2006/0274112 | A1 * | 12/2006 | Jackson Pulver et al. | 347/42 |

* cited by examiner

*Primary Examiner* — Jason Uhlenhake
(74) *Attorney, Agent, or Firm* — Dennis G. Morrell; John H. Lamming

(57) ABSTRACT

This invention pertains to a drop-on-demand ink jet printing method, more particularly to a method of printing wherein a purge image is logically combined with a selected image so as to insure a desired amount of drop firing from every jet of an ink jet printhead for every page printed. The inventive method avoids image defects that could otherwise occur as a result of faulty drop firing from infrequently used nozzles. Purge image data that specifies the deposition of at least one ink dot on at least one predetermined pixel location on each of the plurality of image scanlines is constructed and stored in a purge image memory accessible by the printing apparatus. Imperceptible purge image patterns are constructed having blue noise spatial frequency characteristics and optical density levels equal to or less than 0.01 OD above print medium base OD. A plurality of purge image data sets are constructed and stored for retrieval to adapt to a variety of conditions. Acceptable purge image data sets are determined using a purge performance image as a test pattern which is optically scanned or analyzed by user observation. The present invention further include numerous printing apparatus configured to implement the disclosed methods of maintaining ink jet printheads.

36 Claims, 17 Drawing Sheets

INK JET PRINTING METHOD

BACKGROUND OF THE INVENTION

This invention pertains to a drop-on-demand ink jet printing method, more particularly to a method of printing wherein a purge image is logically combined with a selected image to insure a desired amount of drop firing from every jet of an ink jet printhead for every page printed. The inventive method avoids image defects that could otherwise occur as a result of faulty drop firing from infrequently used nozzles.

Drop-on-demand ink jet printing is a non-impact printing process in which droplets of ink are deposited on print media, such as paper, to form the desired image. The droplets are ejected when needed (demanded) from a printhead in response to electrical signals generated by a microprocessor and are directed to specific locations (pixel positions) on the print media. The printhead and print media are moved relative to each other while drops are ejected so that all pixel positions are traversed along scanlines in the direction of movement. In some ink jet printers a page wide array (PWA) printhead, as wide as the entire image area to be printed and having a sufficient plurality of jets to deposit drops on every image scanline perpendicular to the direction of relative motion, is employed. In other ink jet printers a narrow printhead is scanned in a main scan direction and the medium is advanced in a perpendicular sub-scan direction in increments of image scanlines.

Drop ejection performance suffers as the time interval between drop ejections increases. Because drops are ejected only when "demanded" or needed to form the selected image, there are varying amounts of time between jet firings for each of the jets or nozzles in the printhead based on the density of required drops along the scanline addressed by each jet. Some jets may traverse image areas having all "white" space and so be required to print no drops for one or more full pages of images. Other jets may print almost continuously because they align with lines in the image that run the length of the image area. If a jet remains idle, it has a tendency to become plugged or clogged as a result of ink vehicle evaporation and crusting of the ink or dye precipitation out of the ink in or around the jet, which can result in the formation of a viscous plug in the jet orifice. If a jet has plugged, ink droplets ejected through the jet orifice will be misdirected, which will adversely affect print quality.

Substantial variations in drop volume and ejection velocity, i.e., more than 20% from nominal values, usually results in noticeable image defects in the form of image noise and line raggedness. More severe variations may cause stuttering ejection, non-ejection and misdirection of drops to the point that visible light and dark streaks are formed in the image.

The inventive methods disclosed herein counteract degradation in performance caused by ink evaporation from infrequently used nozzles.

It has long been known and practiced in drop-on demand ink jet printing systems to cause the ejection of non-printing drops in order to restore jet performance. This procedure, commonly termed purging, requires the nozzle to spit on a regular basis into a waste container (spittoon) to expel ink in the nozzle region that has been evaporatively degraded, refilling the jet with fresh ink having the design intention properties, especially ink viscosity and surface tension, which are needed for nominal drop ejection performance.

Most ink jet printing systems in use today are configured with relatively narrow printheads that are repeatedly scanned over the print medium by a carriage mechanism. One or more stationary locations, spittoons, outside of the print medium area are provided to receive non-print drops during purging. Jet performance is maintained satisfactorily as long as the time required to traverse the medium and reach a spittoon, $T_s$, is not so long as to allow an unacceptable amount of ink vehicle evaporation in the nozzle. The time a drop-on-demand ink jet may be held in a waiting state, before firing a print drop having nominal velocity and volume, is commonly referred to as the latency (or decap) time, $T_l$. Thus, for ink jet printers that rely on purging into a spittoon, the design of system elements preferably are balanced so that $T_l > T_s$. The relevant system elements include the ink jet printhead drop ejection process, ink flow path, nozzle region geometry, ink formulation, printhead temperature range, carriage motion profile, location of the spittoon, width of the print zone, and environmental factors such as temperature, relative humidity and elevation.

While spittoons have been successful in many ink jet printing systems, spittoon purging cannot effectively be employed wherein the print media is uninterrupted along the direction of relative motion, as occurs when printing on print media webs or product materials with stationary printheads. Even in the case of moving carriage mounted printheads writing across the media in a main scan and reaching a spittoon or cap location to the side, the width of the media may become so large that the spittoon access time, $T_s$, becomes very large, thereby imposing difficult constraints on ink formulation materials. Very wide carriages, wider than 2 meters, may be used in textile printers and for printers used for large signage applications, leading to much larger spittoon access times than are typical for letter-size media printers. In addition, spittoon purging apparatus must be designed to contain significant volumes of purged ink materials, potentially for the expected life of the machine. Provisions to capture, move and retain purged ink residues frequently result in complex arrangements of multiple porous materials and receptacles. Such purged ink residue handling apparatus are the source of additional reliability problems and present difficulties for the user in self-servicing and refurbishing the printer apparatus. Finally, as ink jet printing has moved to smaller drop volumes for higher image resolution and increased colorant loadings for improved image permanence, the difficulty of achieving large values for ink latency, $T_l$, have increased, further exacerbating the design difficulties of managing an increase in non-print drop purging requirements during image printing.

Therefore, a method of maintaining a drop-on-demand printhead that does not rely on purging into a spittoon during image printing is necessary for certain applications, such as page wide array (PWA) printing on print media webs, and may be highly advantageous for moving carriage architectures by easing ink formulation restrictions and reducing the size and complexity of purged ink receptacles. To that end, the inventive methods and apparatus disclosed herein achieve printhead maintenance by drop purging directly onto the print medium. That is, in order to assure that all jets are operating within a required latency time, drops may be printed based on printhead maintenance information as well as based on selected image data.

Non-image drop purging onto the print medium has been disclosed in U.S. Pat. No. 5,659,342 issued to Lund, et al., on Aug. 19, 1997, hereinafter denoted as Lund '342. Lund '342 discloses methods whereby all nozzles are purged by firing purging droplets into background portions of a print media page. Lund '342 further discloses randomly distributing purge droplets, spacing purge droplets at least three dot widths away from one another, and using a visible pattern, such as a watermark, logo, pleasing image, or the like. Lund '342, however, does not disclose a method whereby an imperceptible purge image is constructed independently of any user selected image information and in a way to insure that every print image scanline will require at least one printed drop during printing.

U.S. Pat. No. 6,166,828 issued to Yamada, et al., on Dec. 26, 2000, Yamada '828 hereinafter, discloses methods of ink jet printing whereby on-print-media purging is done based on the history of usage of a given jet among the plurality of jets in an ink jet printhead. Previous binary print data for each jet is monitored and multi-level data is added to the user selected multi-level image data prior to binarization for pending printing by the jets of the printhead. Thus, the on-print-media purging method described in Yamada '828 is image data dependent and must be constructed anew for each jet for each user selected image, thereby requiring considerable computational resources within the printer system. Further, since the computation of prior history of usage is practically limited to a small set of alternative results, the method may introduce noticeable structured image defects in the form of spatially repetitive purge drops.

U.S. Pat. No. 6,296,342 issued to M. Oikawa on Oct. 2, 2001, Oikawa '342 hereinafter, discloses apparatus for maintaining an ink jet printhead that jets a colorless processing liquid by ejecting drops to the print medium from any jet that has not been used for a predetermined time period. The disclosed processing liquid is deposited to purposefully mix with and chemically alter colored ink dots that have been jetted by colored ink jets in the printing apparatus. This approach of jetting purge drops of the colorless processing liquid at fixed time intervals, if applied in like manner for colored ink jets, would result in a highly perceptible periodic pattern of purge drops that overlays the user selected image.

U.S. Pat. No. 6,402,292 issued to T. Ninomiya on Jun. 11, 2002, Ninomiya '292 hereinafter, discloses apparatus for maintaining a PWA ink jet printhead that jets a colorless processing liquid used in conjunction with a PWA printhead that jets a colored ink. Ninomiya '292 discloses that a preliminary discharge of purge drops from each jet is needed to assure nozzle cleansing prior to the printing of each image. The colorless processing pre-discharges are done onto the cut sheet print media itself whereas the colored ink pre-discharges are done onto a media transport belt in gap areas between transported cut sheets. While the colorless processing liquid pre-discharges may not be perceptible on the final print, pre-discharges of the colored inks would produce a noticeable ragged line across the lead edge of the cut sheet.

U.S. Pat. No. 6,523,932 issued to E. Johnson on Feb. 25, 2003, Johnson '932 hereinafter, discloses a method of maintaining an ink jet printhead that prints on a continuous web by greatly slowing the web below any print mode speed and jetting purge drops onto the web. This method therefore produces ragged ink lines at waste areas between user selected images on the web and may cause loss of printing throughput as the web is periodically slowed to perform the needed purging.

U.S. Pat. No. 6,896,349 issued to Valero, et al., on May 24, 2005, Valero '349 hereinafter, discloses printing apparatus for maintaining an ink jet printhead by printing purge drops onto a sheet of print media provided specifically for that purpose. The apparatus of Valero '349 prints purge drops onto a cut sheet of media and then diverts that sheet into a holding position from which it can be recycled for a number of purge drop print cycles before it is considered exhausted for this purpose. The purge drops of Valero '349 are not combined with user selected image drops and outputted with the user selected image. The Valero '349 apparatus adds the complexity of an auxiliary media path for the purge receiver sheet and cannot provide purge drops within the timeframe of printing a selected image.

U.S. Pat. No. 7,029,095 describes a preliminary ejection of an ink drop which is less than the normal amount of ink ejected. It is suggested that these low volume ink drops will not be conspicuous on the media. Here the printer controller/computational system must count the time since the last ejecting operation and make a decision whether another 'preliminary' ejection of low volume is ejected.

U.S. Patent Application 2006/0214961 describes a preliminary-ejection control method for a plurality of linearly arranged nozzles which periodically ejects ink at a predetermined time during the recording operation of image data, where the ejection of ink is not based on the image data.

U.S. Patent Application 2006/0284922 describes a maintenance method for an array printer. It describes a control unit to control a maintenance operation and the control unit requires accumulating nozzle information presumably in the computer and/or control system for the printer and when the preset reference time is exceeded the spitting operation is performed.

The above noted disclosures of ink jet printhead purging methods and apparatus that print purge drops onto an imaging media are unsatisfactory for reasons of added cost and complexity, generation of noticeable image artifacts, added computational needs, added hardware subsystems, creation of waste, reduction of productivity or inability to purge at time intervals less than a full image print time. Consequently there is a need for ink jet printhead purging apparatus and methods that are responsive to short timeframe purging requirements arising in very high quality ink jet printers using very small drops and short latency inks. Further there is a need for an on-print media purging method and apparatus that can be implemented in a simple fashion and that does not add noticeable image artifacts to user selected images and does not require significant computational capacity.

SUMMARY OF THE INVENTION

The foregoing and numerous other features, objects and advantages of the present invention will become readily apparent upon a review of the detailed description, claims and drawings set forth herein.

In accordance with one aspect of the present invention, there is provided a method for maintaining a plurality of ink jets used in a printing apparatus that forms a selected ink image on a print medium by relatively moving the plurality of ink jets and the print medium in a process direction while ink drops are ejected by the plurality of ink jets. The printing apparatus forms a selected ink image in response to selected image data specifying the deposition of ink dots at selected predetermined pixel locations on a plurality of image scanlines aligned with and extending in the process direction a predetermined image length on the print medium. The method comprises the steps of:

(a) constructing purge image data that specifies the deposition of at least one ink dot on at least one predetermined pixel location on each of the plurality of image scanlines within the predetermined image length;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium.

In the forgoing method, the purge image patterns are constructed such that the purge image is imperceptible on the print media and does not detract from image quality.

The present invention also includes the use of purge image data constructed so that when printed the purge images have optical densities below 0.01 OD and in further embodiments, blue noise characteristics.

The present invention also provides a method for maintaining a plurality of ink jets used in a printing apparatus that forms a selected ink image on a print medium by also relatively moving in a sub-scan direction traverse to the process direction so that each of the plurality of jets are aligned with a plurality of image scanlines while forming the selected ink image. The method comprises the steps of:

(a) constructing purge image data that specifies the deposition of at least one ink dot on at least one predetermined pixel location on each of the plurality of image scanlines within the predetermined image length for each time the image scanline is traversed by one of the plurality of ink jets;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium.

The present invention further provides a method for maintaining a plurality of ink jets supplied with a plurality of inks of different types by constructing purge image data that specifies for each scanline, the deposition of at least one ink dot of each ink type associated with that scanline on at least one predetermined pixel location within the predetermined image length.

The present invention further provides a method for maintaining a plurality of ink jets used in a printing apparatus that forms a selected ink image on a print medium by relatively moving the plurality of ink jets and the print medium in a process direction a predetermined image length in a print time $T_p$ while ink drops are ejected by the plurality of ink jets, the printing apparatus forming a selected ink image in response to selected image data specifying the deposition of ink dots at selected predetermined pixel locations on a plurality of image scanlines aligned with and extending in the process direction a predetermined image length on the print medium, wherein there are a plurality, r, of minimum steady state drop purging frequencies, $f_{pr}$, that are required to maintain a desired ink drop volume and velocity ejected from the plurality of ink jets based on a plurality, r, of conditions, the method comprising the steps of:

(a) constructing a plurality, r, of purge image data sets, $I_{pr}$, so that ink dots are specified for at least $N_{pr}$ predetermined pixel locations on each of the plurality of image scanlines within the predetermined image length, wherein $N_{pr} \geqq f_{pr}T_p$.

(b) storing the plurality of purge image data sets, $I_{pr}$, in a purge image memory accessible by the printing apparatus;

(c) determining which condition, s, of the plurality of conditions, r, prevails;

(d) retrieving the purge image data set, $I_{ps}$, associated with condition s;

(e) receiving selected image data specifying a selected ink image;

(f) logically combining the purge image data set, $I_{ps}$, and the selected image data to create print image data that specifies the deposition of ink dots at every predetermined pixel location based on the purge image data set, $I_{ps}$, or the selected image data;

(g) printing the print image data on the print medium.

The plurality of conditions can include, but are not limited to different temperatures of a printhead, different levels of relative humidity, different altitudes, different ink compositions, different desired ink drop volume and other different conditions that can affect the purge image data.

The present invention further provides a method for maintaining a plurality of ink jets used in a printing apparatus that forms a selected ink image on a print medium by relatively moving the plurality of ink jets and the print medium in a process direction a predetermined image length in a print time $T_p$, wherein there are a plurality, r, of minimum steady state drop purging frequencies, $f_{pr}$, that are required to maintain a desired ink drop volume and velocity ejected from the plurality of ink jets based on a plurality, r, of conditions. The method comprises constructing a plurality, r, of purge image data sets, $I_{pr}$, so that ink dots are specified for at least $N_{pr}$ predetermined pixel locations on each of the plurality of image scanlines within the predetermined image length, wherein $N_{pr} \geqq f_{pr}T_p$. Various embodiments of the invention determine the prevailing condition using data from a physical transducer, user input, or the observation or measurement of a purge test image.

The present invention further includes various printing apparatus configured with an ink jet printhead having a plurality of ink jets supplied with the ink, apparatus adapted to relatively move the printhead and print media, and a memory adapted to store purge image data. The disclosed printing apparatus further comprises a controller adapted to receive selected image data specifying the selected image, to retrieve the purge image data, to logically combine the selected image data and the purge image data forming print image data and to output the print image data to the ink jet printhead; thereby causing the selected ink image to be formed on the print medium and the plurality of ink jets to be maintained. Further embodiments comprise at least one of physical transducer apparatus, a user interface or optical scanning apparatus.

An ink jet printing apparatus for printing a selected ink image on a print medium in the form of ink dots deposited at selected predetermined pixel locations along a plurality of image scanlines aligned with and extending a predetermined image length in a process direction comprising:

(a) an ink jet printhead having a plurality of ink jets supplied with the ink;

(b) apparatus adapted to relatively move the print medium and the ink jet printhead in the process direction while ink drops are ejected by the ink jet printhead;

(c) apparatus adapted to relatively move the ink jet printhead and print medium in a sub-scan direction traverse to the process direction so that each of the plurality of jets are aligned with a plurality of image scanlines while forming the selected ink image; and (d) a memory adapted to store purge image data that specifies the deposition of at least one ink dot on at least one predetermined pixel location on each of the plurality of image scanlines within the predetermined image length for each time the image scanline is traversed by one of the plurality of ink jets;

(e) a controller adapted to receive selected image data specifying the selected image, to retrieve the purge image data, to logically combine the selected image data and the purge image data forming print image data that specifies the deposition of ink dots at every predetermined pixel location based on the purge image data or the selected image data and to output the print image data to the ink jet printhead; thereby causing the selected ink image to be formed on the print medium and the plurality of ink jets to be maintained according to the means described above.

An ink jet printing apparatus for printing a selected ink image on a print medium in the form of ink dots deposited at selected predetermined pixel locations along a plurality of image scanlines aligned with and extending a predetermined image length in a process direction comprising:

(a) an ink jet printhead having a plurality of ink jets supplied with the ink, wherein there are a plurality, r, of minimum steady state drop purging frequencies, $f_{pr}$, that are required to maintain a desired ink drop volume and velocity ejected from the plurality of ink jets based on a plurality, r, of conditions;

(b) apparatus adapted to relatively move the print medium and the ink jet printhead in the process direction a predetermined image length in a print time $T_p$ while ink drops are ejected by the ink jet printhead;

(c) a memory adapted to store a plurality, r, of purge image data sets, $I_{pr}$, so that ink dots are specified for at least $N_{pr}$ predetermined pixel locations on each of the plurality of image scanlines within the predetermined image length, wherein $N_{pr} \geqq f_{pr} T_p$; and (d) a controller adapted to determine which condition of the plurality of conditions prevails, to retrieve the image purge data set associated with the condition determined, receive selected image data specifying the selected image, to logically combine the selected image data and the purge image data forming print image data that specifies the deposition of ink dots at every predetermined pixel location based on the purge image data or the selected image data and to output the print image data to the ink jet printhead; thereby causing the selected ink image to be formed on the print medium and the plurality of ink jets to be maintained according to the method described above.

These and numerous other features and advantages of the present invention will be more readily understood by those of ordinary skill in the art from a reading of the following detailed description. It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any subcombination. In addition, references in the singular may also include the plural (for example, "a" and "an" may refer to one, or one or more) unless the context specifically states otherwise. Further, reference to values stated in ranges include each and every value within that range.

BRIEF DESCRIPTION OF THE DRAWINGS

In the detailed description of the preferred embodiments of the invention presented below, reference is made to the accompanying drawings, in which.

DETAILED DESCRIPTION OF THE PREFERRED EMBODIMENTS

The present description will be directed in particular to elements forming part of, or cooperating more directly with, apparatus in accordance with the present invention. Functional elements and features have been given the same numerical labels in the figures if they are the same element or perform the same function for purposes of understanding the present invention. It is to be understood that elements not specifically shown or described may take various forms well known to those skilled in the art.

Figure 1:
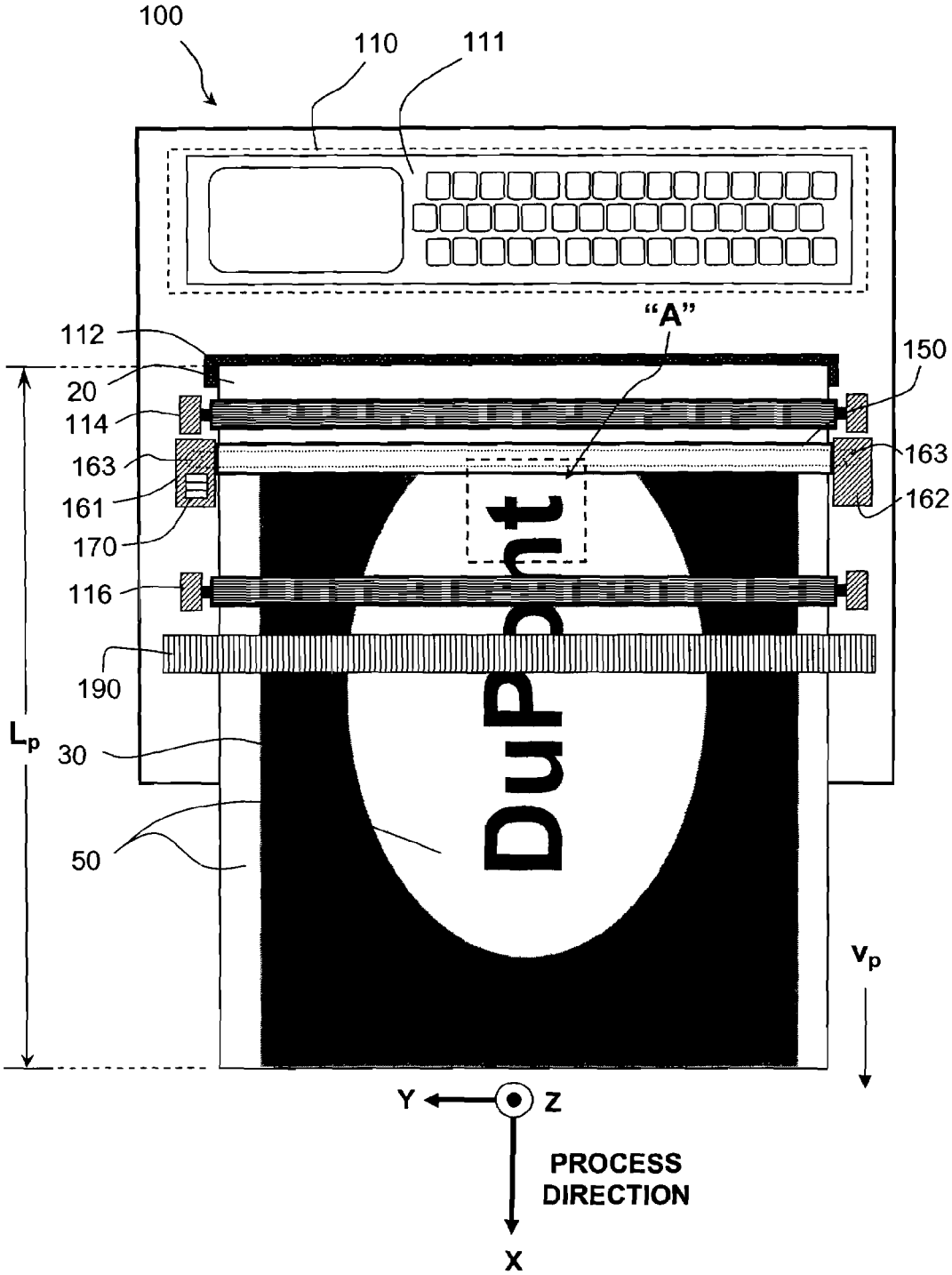
FIG. 1 depicts a page wide array ink jet apparatus using the on-print-image purging methods of the present invention.

Referring to FIG. 1, there is shown in top plane view an ink jet printing apparatus 100 that utilizes a stationary page wide array (PWA) ink jet printhead 150 according to some preferred embodiments of the present invention. A cut sheet print medium 20 is depicted emerging from a media supply mechanism (not shown) located below the plane of the FIG. 1 drawing via slot 112. Print medium 20 is transported underneath PWA printhead 150 by means of in-feed drive roller 114 and out-feed drive roller 116. The direction of relative motion between PWA printhead 150 and print medium 20, indicated as the "X" direction in FIG. 1, is termed the process direction for this embodiment. The process direction is the direction of relative movement between media and ink jet printhead while drops are ejected by the ink jets. This designation of the process direction and labeling as the "X" axis direction is used throughout this disclosure. PWA printhead 150 is comprised of a plurality of ink jets arrayed along the "Y" axis direction, there being one jet for each image scanline that can be printed along the Y-axis, perpendicular to the process direction "X". Drops are ejected from ink jets (not visible)

having nozzles on the underneath side of PWA printhead 150 in the "Z"-axis direction, downward toward print medium 20 in FIG. 1.

Print media 20 is transported past the PWA printhead 150 at a process velocity of $v_p$. A predetermined image length, $L_p$, in the process direction is also indicated. Typically the predetermined image length is substantially equal to the media length or width in the process direction less any margin necessary for reliability concerns of ink over spraying the media edges. The time required to traverse the media, $T_p$, is therefore $T_p=L_p/v_p$. This time is an important design consideration for the methods of the present invention in that it represents the minimum time during which the on-print-image purging method must maintain jetting performance.

A selected user image 30, the word and logo "DuPont", is illustrated as having been largely completed as cut sheet print medium 20 has largely been passed by PWA printhead 150. Faint shading 50 is indicated on print medium 20, visible along the left and right margins and within the oval area of the DuPont logo. Faint shading 50, visible only for the purpose of understanding the present invention, is an illustration of the printed purge image that results from logically combining purge image data and user selected image data to form a combined image according to the present invention. Faint shading 50 will be interchangeably termed the "printed purge image" and, rather than being visible as is depicted in several Figures of this disclosure, is purposefully designed to be imperceptible to humans under normal viewing conditions and distances for the type of print image normally produced by the printing apparatus.

Other features of printing apparatus 100 of the present invention depicted in FIG. 1 include an electronics subsystem 110 indicated by a phantom line box and user interface 111 located at an upper surface of printer 100. Electronics subsystem 110 comprises a memory to store purge image data, a controller that is adapted to implement the methods of the present invention as well as other electronics apparatus as may be needed to operate the media supply path, ink supply subsystem and user interface, power and control the ink jet printhead, interface with any physical transducers and optical sensors, and receive user selected image data and instructions. User interface 111 is used for some preferred methods of the present invention to enter data that is used to determine an appropriate purge image data set from among a plurality of stored purge image data sets. Such input data may be based on, for example, user observations of image defects or a specialized test image, type of inks loaded, print media properties, and selected print quality mode.

PWA printhead 150 is supported above the print media path by end blocks 161, 162. Ink is supplied to PWA printhead 150 via ink line 163 (shown in phantom lines) from an ink supply system (not shown) located below the plane of the FIG. 1 drawing. A physical transducer apparatus 170 is illustrated affixed to end block 161. For some preferred embodiments of the present invention some external physical factors that influence ink/printhead latency times are measured and used to select an appropriate purge image data set. The external physical factors that may be utilized include, for example, the temperature of PWA 150, temperature of the printing apparatus, temperature of the general environment of the printing apparatus, relative humidity, altitude above sea level and the rate of change of such physical factors.

Printing apparatus 100 is further equipped with optical image scanner 190 located downstream of out-feed roller 116. Optical image scanner 190 has illumination and sensing elements for measuring the just-printed ink image. For some preferred embodiments of the present invention to be discussed hereinbelow, an optical image scanner is used to measure a purge image test pattern that is constructed to show performance differences among a plurality of purge image data sets.

Figure 2:
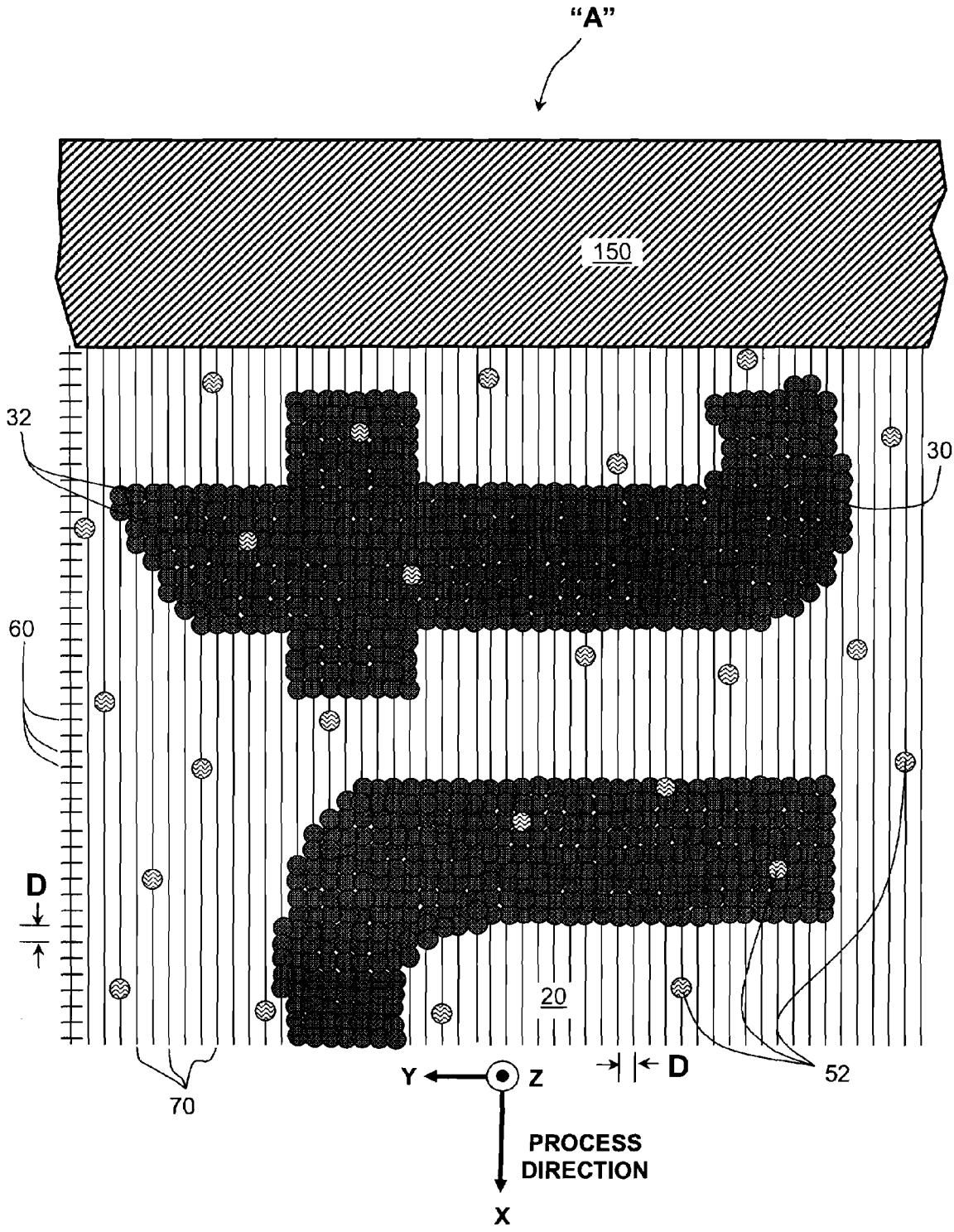
FIG. 2 depicts an enlarged view of portion "A" of FIG. 1.

An enlarged area, portion "A" of the print image depicted in FIG. 1, is depicted in FIG. 2. FIG. 2 illustrates part of the "nt" of "DuPont" emerging from beneath PWA printhead 150. The printed image is comprised of ink dots 32 that have been deposited at selected predetermined picture element (pixel) locations 60 along image scanlines 70 as a result of user selected image data. That is, image dots are placed at pixel positions spaced apart a distance "D" along the "X" axis, the process direction, and the image scanlines are spaced a distance "D" along the "Y" axis. The print image data, which is composed of a logical combination of selected image data or purge image data, consists of an X-Y matrix of binary values that ultimately direct the printhead to either eject a drop or not when in position over each X-Y pixel position. An image matrix having equal resolution distances of "D" along both X and Y axes is depicted in all examples discussed herein, however ink jet printing systems having different densities of pixels along axes in the image plane are also practiced in the art and may be also be utilized while practicing the present invention.

Print image ink dots 52, illustrated in FIG. 2 using lighter shading than ink dots 32, are part of the printed purge image. Printed purge image dots 52 fall both inside and outside the "nt" of the user selected image. Not all scanlines 70 are illustrated to have printed purge image dots within the small image area portion "A". However, these scanlines will have purge image dots in other areas (not shown) of the printed page. As will be further described below, the purge image is constructed independently of any user selected image. The purge image data is designed to have a required number of print drops for every image scanline to ensure that each jet makes a required number of drop ejections to maintain nominal performance in terms of drop volume, velocity, firing direction, or any other performance parameter affected by ink/printhead latency times. The purge image data is further designed to result in an imperceptible image when printed alone. The drop volume of the printed purge image dots are similar to the drop volume of the normal image dots; the drop volume of the printed purge image dots are not independently controlled by the instant invention. If the printer has variable drop volume capability, the purge image drop volume can be variable, but drop volume variability is optional for the printed purge image dots.

The term "imperceptible" is used herein to mean that the printed purge image is not noticed by a majority of human observers under normal viewing conditions. For example, if the printing application is for printing letter-sized documents (A4 or 8.5"×11") used for most home, school and office communications, normal viewing conditions are normal home, school or office lighting and a reading distance of 30-40 cm. For larger format images, i.e. those printed by wide bed ink jet printers, normal viewing conditions are considered to scale upward from the familiar letter size conditions. For example, a 36" wide plotter image is approximately four times wider than a letter size image so normal viewing distance would be four times farther away, i.e., 120-160 cm.

The term "imperceptible" is also used herein to mean that the printed purge image is not noticed due to the normal expectations of image quality of the human observer-users of the selected ink images. For example, in textile or large signage printing, purge image dots may be large enough to be seen individually if attended to, however, they are not noticed under normal viewing conditions because their occurrence is not objectionable and not unlike stray ink image spatter created by alternate printing methods to ink jet. Purge image data is constructed "off-line" to maximize effectiveness in maintaining a chosen combination of ink formulation and ink jet printhead design while using a minimized amount of "purge" ink, and while paying careful attention to the characteristics of the human visual system. For the preferred methods of the present invention, pre-constructed and stored purge image data is combined with user selected image data in a logical "or" fashion for each printable pixel location within the area that can be imaged by the ink jet printhead. Consequently, for some pixel locations only a purge image dot is specified, for some pixel locations only a selected image dot is specified and for some pixel locations both are specified. In this last instance, wherein both purge and selected image data sets call for a dot at a specific print image matrix location, only one drop is printed. This deposited drop may be understood to serve as a functional purge drop as well as a user selected image drop. The purge image data operates to assure a minimum amount of drop ejection from all jets by causing the simultaneous printing of a purge image on the medium. The consequence for the human observer, if the purge image data is constructed according to the present invention, is to raise the optical density of the base print medium by a small, imperceptible, amount.

Although the invention has been described to be applicable with a page wide array printer system it can also be applied to other printhead/printer configurations including, but not limited to an array printer with a partial width printhead which prints along one edge of a preprinted image or other document, wide format printers, a recirculating print media system, and traditional carriage mounted printhead configuration printers where the printhead moves relative to the media. The present invention is advantageous in these applications because it provides for the maintenance of the various printhead configurations wherein the position of the printhead may be changed without needing to relocate a spittoon position or to interrupt high speed annotation to access a spittoon.

The term "ink" is used herein to refer to a liquid that is visible to humans under the normal viewing conditions of the printing application. Usually this means that the ink has a colorant material, a dye or a pigment that absorbs human visible light. However there may other jetted liquids that contain chemicals that alter the media or layers or chemicals on the media to become visible. Further, there may be jetted liquids that become visible only under special lighting conditions or on particular media surfaces. For example, a "white" ink may be visible if the print medium is a color other than a matching "white". For the purposes of the present invention all liquid materials that are jetted to form a visible image are considered to be inks that, if used in the practice of the present invention, fall within the metes and bounds of the present invention.

For all of the configurations of ink jet printing apparatus depicted herein, the ink jet printheads may be comprised of multiple arrays of jets supplied by inks of different types. Usually the inks of different types will be inks of different colors or inks having the same colorants in different weight loadings for the purpose of expanded gray scale rendition.

That is, for the general case of a plurality of ink types, a plurality of purge image planes are constructed, one for each ink type. Likewise the user selected image data will be comprised of selected image planes for each ink type to be printed. Print image data is also composed of a print image plane for each ink type to be printed. The print image planes are formed as a logical combination of selected image data or purge image data for each print image plane, consisting of an X-Y matrix of binary values that ultimately direct the printhead to either eject a drop or not when in position over each X-Y pixel position, for each ink type.

The purge image data is constructed to be imperceptible when printed as a purge image. In the case of multiple ink types, it is the combined print image having the plurality of print image planes for each ink type that is judged for imperceptibility. Therefore the construction of the individual purge image planes is preferably carried out iteratively to minimize perceptibility. For example, if the ink jet printing apparatus uses a four color printing method of black (K), cyan (C), magenta (M), and yellow (Y) inks, then the purge image data for CMYK planes are iteratively adjusted to avoid the overlapping of purge dots into visible clusters or situations of periodic color hue shift. For some preferred embodiments, the total printed purge image has an optical density of less than 0.01 OD above media base. Therefore, each individual CMYK plane cannot individually result in a printed purge image plane that is 0.01 OD above base. In this case it is expected that the K printed purge image plane might reach 0.005 OD above media base and the CMY printed planes in combination might reach 0.005 OD above base.

It is also contemplated by the present invention that inks of different types may exhibit different latency times. A convenient way of characterizing ink/printhead latency is to experimentally determine a steady state drop ejection frequency that sustains nominal jetting performance for each jet fired individually. "Steady state" may be considered to be a time on the order expected for the jet to be sustained in an uncapped state without the intervention of ejecting non-printing drops into a spittoon location. In other words, a minimum "purging" frequency, $f_p$, is determined by observing jetting performance degradation as the steady state drop ejection frequency is reduced. The minimum purging frequency is approximately the inverse of an overall ink/printhead latency time, $T_l$. Jetting performance degradation may be observed by directly measuring ejected drop volume, velocity and firing direction or inferring it from the measurement of printed dot sizes and positions. In practice, the minimum purging frequency is considered an engineering value that characterizes the effect of many variables on the sustainable non-printing time for a jet and preferably includes some reliability safety margin of drop firings.

Typically it is found that the minimum purge frequency is affected by a large number of factors such as the ink jet printhead drop ejection process, ink flow path, nozzle region geometry, ink formulation, printhead temperature range, carriage motion profile, location of the spittoon, width of the print zone, and environmental factors such as temperature, relative humidity and elevation. Consequently, an effective approach is to measure the minimum purge frequency over the full range of design, ink formulation, and environmental conditions anticipated for the operation of the printing apparatus. A plurality, r, of minimum purge frequencies, $f_{pr}$, may then be used to capture a range of printing apparatus conditions for which different purge image data sets are designed.

Since different types of inks may have different evaporative behaviors or may be jetted from differently sized nozzles, the needed minimum purge frequencies, and associated purge image data sets, may result in different required densities of purge image dots per unit image area. Thus, in a CMYK printing application, the black ink formulation may lead to a requirement for more black ink purge dots per square centimeter than is needed for the magenta ink purge image plane which, in turn, requires more than the yellow ink purge image plane. However, the imperceptibility of the total purge image is a critical requirement of the present invention. Therefore, to preserve imperceptibility the number of purge image dots may be increased above the minimum required in order to achieve a neutral color balance for the total printed purge image or to eliminate periodic color patterns resulting from different purge image dot densities for different ink types within the printed image. A practical approach is to construct the purge image plane for the ink with the highest minimum purge frequency first and then add in the purge image planes for the additional inks in descending order of minimum purge frequency. Purge image dots for the least densely populated purge image planes may then be added in to adjust for color artifacts in the total printed purge image.

Figure 3:
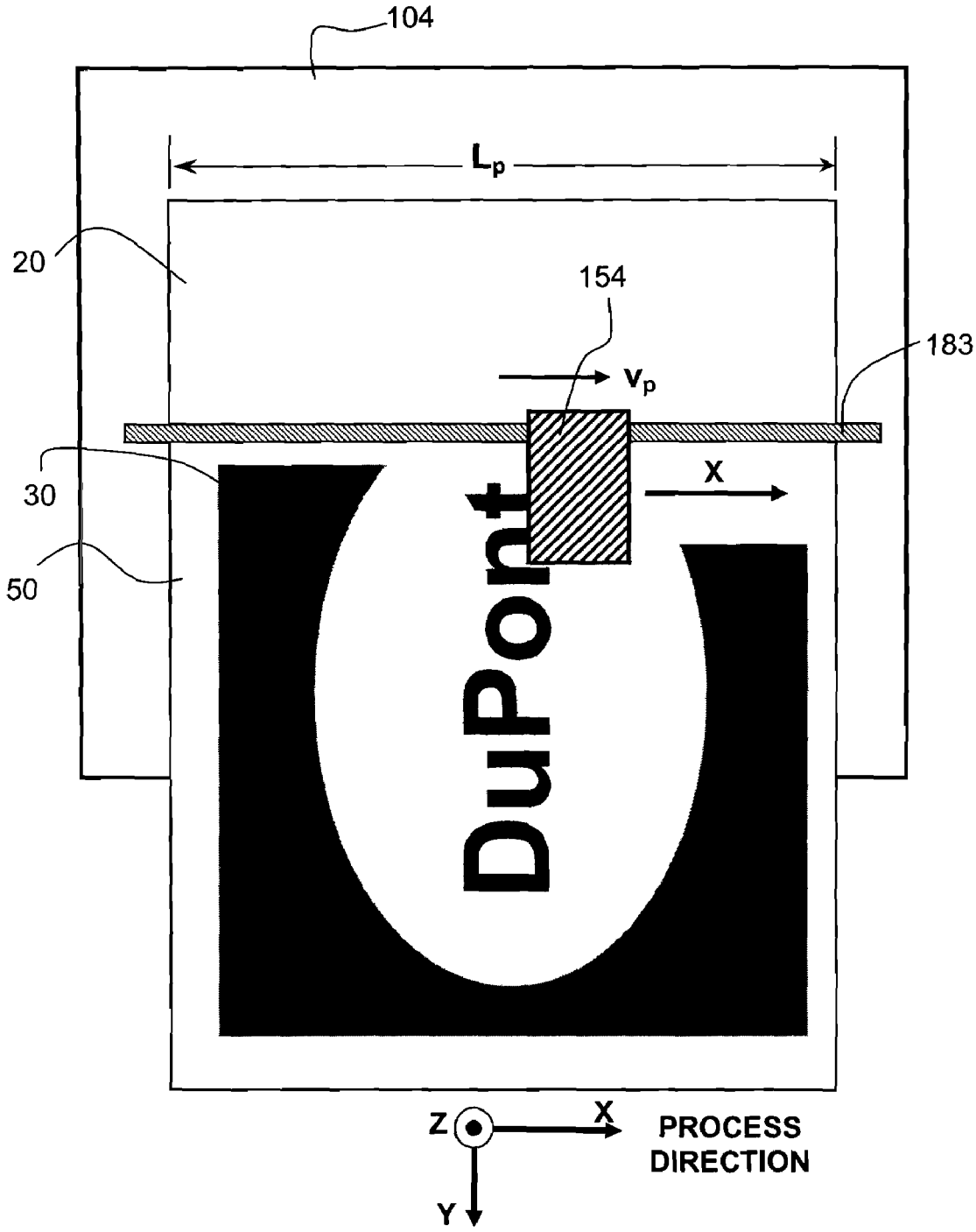
FIG. 3 depicts a moving carriage embodiment of the present invention.

FIG. 3 depicts further preferred embodiments of the present invention wherein a traditional carriage mounted printhead configuration is employed. In carriage printer 104 the carriage movement mechanism is schematically illustrated by rod 183. For such configurations the process direction, "X", is oriented along the direction of carriage motion. Image scanlines 70 are written while the print medium is held stationary and ink jet printhead 154 is moved to transport the plurality of jets in printhead 154 so that predetermined pixel locations are addressed in turn across a swath of print image the width of the array of jets. In FIG. 3, like elements to those in FIGS. 1-2 are labeled with the same element numbers.

Ink jet printhead 154 is transported over print media 20 at a process velocity of $v_p$. A predetermined image length, $L_p$, in the process direction is also indicated. Typically, the predetermined image length is substantially equal to the media length or width in the process direction less any margin necessary for reliability concerns of ink over spraying the media edges. The time required to traverse the media is an important design consideration for the methods of the present invention in that it represents the minimum time during which the on-print-image purging method preferably maintains jetting performance. It may be appreciated that for carriage architecture printing apparatus having very wide media beds, for example, 2 meters or more for textile and billboard panel printing, the traverse time may become quite large. The present invention are advantageously used for such very wide format carriage printers to obviate the need to interrupt printing to reach a spittoon or to allow ink/printhead design combinations to have latency values that are less than the carriage traverse time.

In general, the methods of the present invention operate in similar fashion for a carriage printer configuration as well as for stationary printhead configurations. However, one of the most used capabilities of carriage configuration ink jet printing is multi-pass printing wherein image scanlines in the process direction are completed during two or more passes of the printhead. These multiple passes may be in the same direction of carriage motion (unidirectional) or during reciprocating passes (bidirectional). In addition, the print media may be advanced in the sub-scan direction (Y-axis in FIG. 3) some number of scanlines between passes. This combination of multiple printhead passes and media advance allows the printing of pixels to be distributed in time (between passes), among jets (by means of media advance) or both. Such print modes lessen the effects of jet-to-jet variations and allow inks of different colors to be locally absorbed by the print media, reducing inter-color bleeding.

Construction of purge image data sets for a multi-pass, multi-jet-per-scanline imaging mode must provide the needed purge image dots for each jet for each pass of the printhead for each ink type. Further, a print mask is used to assign predetermined pixel locations on each scanline to the multiple passes of the printhead. For example, the print mask may be a simple odd/even arrangement that allows odd pixel locations to be printed by the first ink and even numbered pixel locations to be printed by the second ink on the first pass of the printhead. Then, on the second pass of the printhead, even numbered pixel locations may be printed by the first ink and odd numbered pixel locations by the second ink. Consequently, for a two-pass, odd/even print mask arrangement, the purge image plane data associated with the first and second ink types will have purge drops assigned to odd and even pixel locations along each scanline in sufficient numbers to satisfy the minimum purge frequency requirements for each ink type. For more complex multi-pass and print mask combinations the purge image data construction will be more complex to implement. However, since according to the present invention this is done "offline", it is not difficult to create an image that provides purge image dots for each jet and each pass within the printed purge image. Further, in this offline construction process, purge image data set "candidates" may be analyzed for observer perceptibility and adjustments made to eliminate periodic artifacts that may arise from the multi-pass manner in which the purge image data is printed. Because purge image dots must be provided for each image scanline for each printhead pass, the total number of purge dots required may increase as higher pass print modes are selected. Some of this increase may be compensated by increasing the process speed accordingly since print drops are not required for every predetermined pixel location during a given pass of a multi-pass print mode. Fewer actual purge dots are required to achieve a necessary minimum purge frequency if the process speed is increased.

Imperceptibility of the printed purge image data remains a critical requirement in the practice of the present invention. If a multi-pass mode drives the number of purge image dots to levels that become perceptible, then other engineering measures are preferably invoked that lessen the number of purge image dots required. For example, the ink formulation might be changed to increase latency, the drop ejection energy increased to improve the ink ejection process latitude, or the mechanical system altered to increase the process speed. That is, if the minimum purge frequency requirement, coupled with the effect of multiple passes, each requiring the printing of purge drops, necessarily leads to perceptible printed purge images, then measures taken to reduce the minimum purge frequency, increase the process speed or both, may allow the density of the printed purge image to be reduced to a level below perceptibility.

A further printing apparatus embodiment of the present invention is an arrangement wherein the print medium is transported past ink jet printhead in a re-circulating fashion. The re-circulating media path may be formed by a drum rotated on an axis, which holds the media on its outer surface. An alternative re-circulating media path could be formed by an endless belt to which the media is attached. In these configurations of an ink jet printing apparatus the process direction is along the direction of circumferential motion. The methods of the present invention are carried out for this printer architecture in analogous fashion to the printer configurations previously discussed. The only difference is that the re-circulating paper media configuration allows a multi-pass mode to be used in conjunction with a page wide array printhead. If this combination is employed, then, as discussed above, the purge image data is constructed to have a needed number of purge image dots for every image scanline and for each time the image scanline traverses one of the plurality of jets of the printhead. An advantage of the re-circulating media path is that high printing process speeds are achievable by the mechanical system. Therefore it is straightforward to increase the process speed for multi-pass print modes, thereby reducing the number of purge image dots needed per pass to achieve a desired purge frequency. On-print-image purging according to the present invention is advantageous for this recirculating printer architecture by eliminating the difficult engineering task of providing a spittoon location accessible during image printing.

Figure 4:
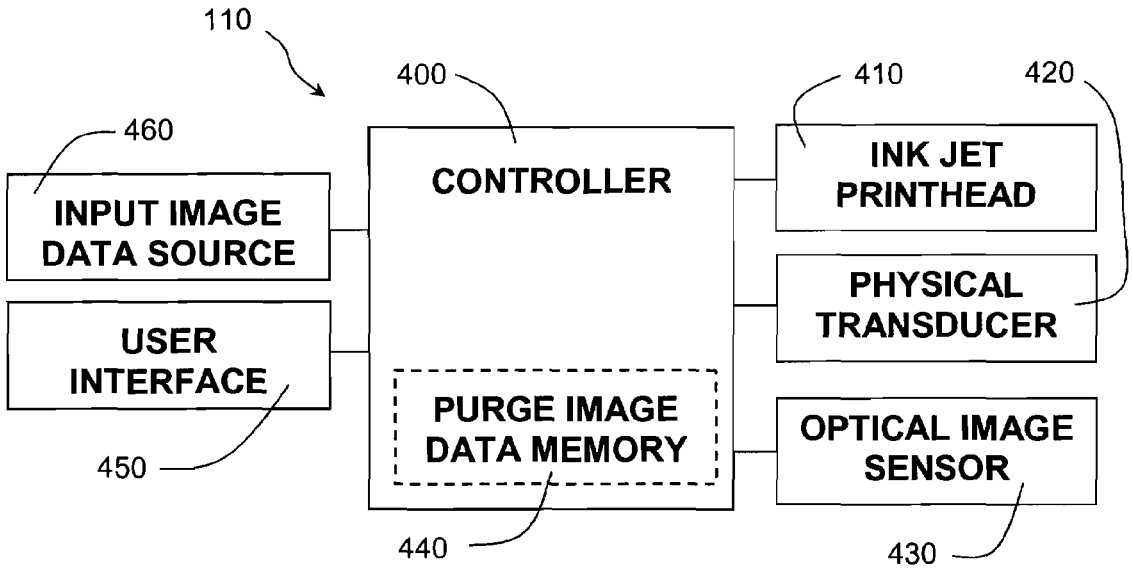
FIG. 4 depicts a schematic representation of an electronics subsystem according to the present invention.

FIG. 4 depicts schematically an electronics subsystem 110 that may be provided to practice the present invention. This subsystem is comprised of a controller 400 and a purge image data memory 440 for storing purge image data sets, purge image test patterns and other information needed to perform the purging methods of the present invention. Controller 400 interfaces with a user interface 450, an input data source 460, an ink jet printhead 410, physical transducers 420, and an optical image sensor 430. Not all of these components are used for every embodiment of the present invention. Also, the purge image memory, while shown as being contained within the controller, need only be accessible to the controller and externally connected in similar fashion to the other elements diagrammed in FIG. 4. Controller 400 is comprised of sufficient computational capacity, memory capacity, firmware, software, I/O interfaces, power supplies, and the like, to implement the methods of the present invention.

The task of designing and constructing a purge image data set involves two main conceptual elements: (1) what is needed to maintain individual jet performance? and (2) what is needed to render the printed purge image imperceptible?

It has been previously noted above that the phenomenon of drop-on-demand ink/printhead latency, i.e., the effect on jetting performance of waiting to print, depends many variables. For the purpose of understanding the present invention it is not necessary to understand the many factors involved in detail. Rather it is sufficient to recognize that, operationally, a drop on demand printhead has a finite waiting time, or latency, for most inks that are used to achieve high quality printing. Indeed, if an ink/printhead combination has sufficient latency to perform properly in an uncapped state for the full set of printing tasks for which the printing system is used, then the methods of the present invention are not needed.

As previously discussed above, a minimum "purging" frequency, $f_p$, is readily determined by observing jetting performance degradation as a steady drop ejection frequency is reduced. For printhead design geometries in which many jets share a sub-reservoir of ink along the ink supply path, there may be some inter-jet effects that arise from the necessity to refresh the ink supply path upstream of the nozzle region itself. Consequently, the minimum purging frequency is preferably determined by examining performance when individual jets are exercised as well as when varying numbers of jets that share restricted ink supply pathway areas are exercised together. Jetting performance degradation may be observed by directly measuring ejected drop volume, velocity and firing direction or inferring it from the measurement of printed dot sizes and positions. In practice, the minimum purging frequency is considered an engineering value that characterizes the effect of many variables on the sustainable non-printing time for a jet and preferably includes some reliability safety margin of drop firings.

For the purposes of the present invention it is assumed that a minimum purge frequency that will assure adequate jet performance exists. Further it is assumed that a plurality of such minimum purge frequencies, $f_{pr}$, have been determined for a plurality of conditions, r, when it is desired to tailor the purge image data to a prevailing condition, s (of r), usually for the purpose of reducing the total number of purge drops used if changing conditions allow. For example, some ink types may have a lower minimum purge frequency than another so that the purge image data plane for that ink need not have as many purge dot pixel locations per image scanline. Or, the user may select a print quality mode that allows more deviation in jet performance from nominal target values, thereby allowing a lower minimum purge frequency for that print mode, and allowing a purge image data set to have fewer purge image dots per image scanline than are needed for a higher quality mode.

Once a minimum purge frequency is determined for a given set of printing apparatus variables, i.e., for a given condition, the average optical density of the printed purge image is largely determined as well. That is, the ink jet printing process speed, $v_p$, and the predetermined image length in the process direction, $L_p$, result in a time required to traverse the media, $T_p=L_p/v_p$. If each jet is exercised at an average drop ejection frequency of $f_p$ to maintain performance, then $N_p$ drops and dots per image scanline will be deposited where:

$$N_p=f_pT_p=f_pL_p/v_p \tag{1}$$

The number of dots per scanline may be re-cast in terms of the print drop jetting frequency, $f_j$, and pixel location spacing, D, along an image scanline as follows:

$$v_P=Df_j \tag{2}$$

$$N_p=(f_p/f_i)(L_p/D); \tag{3}$$

where $v_p$ from Equation 2 is substituted into Equation 1 to arrive at Equation 3. From Equation 3 it is seen that the number of purge image dots per scanline needed is proportional to the ratio of the minimum purge frequency and the jetting frequency used for image printing. The term $(L_p/D)$ in Equation 3 is the total number of pixel locations, hence print image dots, along the image scanline. If the number of purge image dots per scanline, $N_p$, is normalized by the total number of print image dots per scanline $(L_p/D)$ then the approximate amount ink area coverage, $A_p$, of the printed purge image is seen to be:

$$A_p=N_p/(L_pD)=f_p/f_j \tag{4}$$

The purge image area coverage, $A_p$, may also be thought of as a purge image gray level, $G_p$, in that considering each image scanline as a unit area of the print image plane, a ration of $f_p/f_j$ pixels in that area are made to be light absorbing.

For example, consider an ink jet printer configured as depicted in FIG. 1 wherein the pixel density is 1200 dots/inch (dpi) and the process speed is 5 inches/second. The jetting frequency, $f_j$, required of each jet is 6 KHz. If the minimum purge frequency, $f_p$, was determined to be 200 Hz, then $A_p=1/300$ th. That is, the average density of purge image dots along a scanline needed is 1 out of 300, corresponding to a purge image gray level density of approximately 1/300 th of the full ink coverage optical density, $D_{max}$.

$$G_p\approx A_p=f_p/f_j \tag{5}$$

If the gray level of the printed purge image is above a perceptible value, then engineering steps are needed to reduce the minimum purge frequency or increase the printing process speed until the purge image gray level is imperceptible.

The question of what is needed to make the printed purge image imperceptible is now addressed. In the paragraphs below common understandings of the human visual system (HVS) will be used to arrive at some boundaries of perceptibility. However, the task of constructing an imperceptible image purge data set may also be undertaken in a practical empirical fashion by testing candidate purge image patterns with a sample group of potential printing system users to guide the choice of the best compromise between perceptibility and printhead maintenance robustness. For example, textile and other large format printing applications have user expectations of image quality that may allow purge image data set choices that are not acceptable for letter-size document printing. This is especially true for preferable drop or spot sizes that may be used in conjunction with the imperceptible printed purge images of the present invention.

A first step and test of a potential purge image data set is to ask: What average gray level is required to meet the previously established minimum purge frequency necessary for jet performance maintenance? and, Is this gray level noticeable to a majority of viewers under normal viewing conditions? From Equation 5 above we may estimate the average optical density resulting from the minimum purge frequency, $OD_p$ from the reflectance of the minimum purge area coverage, $R_p$:

$$OD_p=-\log(R_p)\approx\log(1-A_p)=\log(1-f_p/f_j), \quad (6)$$

wherein this value is above the base optical density of the print media. This estimate also assumes that light is completely absorbed by the purge ink dots in an area the size of a picture element. For the above example wherein the frequency ratio was 1/300, $OD_p=-\log(1\frac{1}{300})=0.00145$ OD.

Experience in electrophotographic printing and lithographic has taught that the perception of background toner or ink scumming in lithographic printing on paper media begins at OD levels above base near 0.01 OD or somewhat higher. A background toner or ink scum level of 0.01 OD above the base media is considered acceptable for these printing technologies. Typical white papers have a base optical density of ~0.1 OD so this represents about 10% of the typical media reflectance OD. For the purposes of the present invention it is assumed that the optical density of the printed purge image is preferably less than 0.01 OD above the print media base. At this level it will not be perceived by most observers at normal viewing distances or lighting conditions. However, as noted previously, higher levels of purge image optical density may be acceptable in some ink jet printing applications if perception test results from actual users confirm that this is the case.

Using 0.01 OD as a preferred upper level for $OD_p$, an upper level for the frequency ratio $f_p/f_j$ may also be recognized. That is, an image OD of 0.01 implies a printed purge image area coverage, $A_p=1-(1/10^{(0.01)})=0.0227$ or a ratio of ~1/44. For a four color CMYK image application, the 0.01 OD maximum level is shared among four ink purge image planes. If nearly half of the permissible printed purge image optical density is allocated to the black printed purge image, then the maximum ratio of $f_p$ to $f_j$ is preferably 1:100 or less. Or, alternatively, the maximum ratio of predetermined pixel locations in a scanline that are specified as purge image dots is preferably less than 1 out of 100. Using this level as an upper limit on the purge image data should provide some perceptibility margin. Also, at this level the ink usage overhead for on-print-image purging maintenance will be less than adding 1% image coverage to the users selected images.

From both an image perception viewpoint and minimizing usage of ink for maintenance purposes, the lowest effective minimum purge frequency should be used. In the example above, the jetting frequency required to print 1200 dpi images at 5 ips (~30 prints/minute, long edge feed) was 6 KHz. Therefore a minimum purging frequency of 600 Hz for a black ink jet array could be permitted without creating a purge image optical density greater than 0.0044 OD for the black image plane. Ink/printhead combinations used in commercial applications today achieve minimum purge frequencies an order of magnitude lower that 600 Hz, even for systems jetting drops of a few picoLiters volume. Consequently, it is expected that the methods of the present invention may be implemented using purge image data sets that yield printed purge image optical densities in the range of 0.001 OD for a black image or for CMY purge image planes in total.

If the overall optical density of the printed purge image is imperceptible, i.e. below 0.01 OD, the next consideration is whether the average optical density is imperceptibly distributed spatially. The contrast sensitivity function (CSF) of the human visual system (HVS) from well accepted psychometric measurements, reported by S. Hemami, "Perception of extremely low-rate images & video: psychophysical evaluations and analysis," Cornell University, January, 2001. The CSF measures optical contrast (amplitude) necessary in order for human observers to perceive sine wave images at different spatial frequencies on the retina. CSF curves are averages over a large number of observers. The CSF is expressed in units of cycles per degree (cpd) subtended at the eye. This metric for expressing the spatial frequency removes the variable of the viewing distance.

The HVS operates within a spatial frequency range of approximately 0.1 cpd to 45 cpd before falling off in sensitivity 1.5 orders of magnitude at the low end and 3 orders of magnitude at the high end. At a normal viewing distance of 35 cm, a pattern of length 6.1 mm subtends 1 degree of visual angle. Therefore, the contrast sensitivity function range of 0.1 cpd-45 cpd translates into visible sine wave patterns on a print image viewed at 35 cm in the range of 0.016 c/mm-7.4 c/mm. At the high end of spatial sensitivity, a strong 7.4 c/mm pattern would result from printing every other dot at an image pixel density of ~360 dpi. An isolated dot having a diameter of one-half a cycle at 7.4 c/mm, i.e. ~68 microns, may also be visible to many people with sufficient illumination. However for smaller dots the HVS rapidly degrades to the point that no measurable response is expected for patterns beyond 60 cpd or 10 c/mm at 35 cm viewing distance. This means that it is unlikely that viewers will have any spatial recognition of dots smaller than ~50 microns when viewed at distances of 35 cm or greater.

The CSF may be understood to indicate that individual purge image dots are "disappearing" as individually perceived objects as their size is reduced below ~70 microns at normal viewing distances. This is for very high contrast dots such as for black ink dots. For lower contrast inks, such as yellow or a light cyan or light magenta, the disappearance of printed purge dots will begin at somewhat larger diameters. For the purposes of the present invention, an upper limit on applicable dot size of 50 microns is adopted as being an imperceptibility limit unless actual human observer testing establishes that larger diameter dots are acceptable.

The ink drop size that results in a 50 micron dot depends on several factors including print media surface morphology and adsorptivity, ink surface tension and viscosity, and drop kinetic energy. These various factors are lumped together experimentally by measuring a droplet spread factor, $S_d$, where $S_d=D_d/D_S$, and $D_d$ is the ink drop diameter and $D_s$ is the dot or spot diameter. Spread factors normally observed for drop-on-demand printing on various paper media range from ~1.2 to 2.0. As drops are made smaller for higher resolution printing, the spread factor moves to the lower end of this range because the reduced drop mass also means lower kinetic energy is available to counteract surface tension forces that resist drop spreading. Except for textile or very large media format uses, for the purposes of the present invention, an upper limit on drop size of about 12 picoLiters is adopted as being a perceptibility limit for high contrast inks, such as black. A drop of this size would spread to form a 50 micron spot if the spread factor is at the upper end of the observed range, i.e., $S_d=1.8$. As noted above larger drops may be permitted for lower contrast inks or if the spread factor is at the lower end of the spread factor range. For textiles the drop size can be up to about 40 picoLiters and the spread of the dot can be more because the ink tends to penetrate the textile more than other substrates. The perceptibility of the larger drop sizes is still negligible.

The above discussion has addressed the overall gray levels and individual dot or drop sizes that will assure an imperceptible printed purge image. The remaining consideration is the perception of the pattern of dots that is generated by the purge image data set. A CSF with a peak visual sensitivity to spatial frequencies generally between 0.6 cpd and 10 cpd would translate into spatial frequencies of 0.1 c/mm to 1.7 c/mm. Because of this heightened sensitivity to spatial frequencies in this range, even the very low contrast image patterns presented by very low average OD printed purge images may result in perceptible "signal".

It is helpful to examine candidate purge image patterns using Fourier analysis techniques. A large amount of research into the HVS has found that the HVS response operates somewhat like a Fourier analyzer, responding to different spatial frequency components present in a image according to the CSF described above, among other effects. Therefore, Fourier analysis of very low density, sparsely pixilated, purge image patterns is very useful in understanding the potential affect on the HVS, i.e. on the perceptibility.

Discrete Cosine Transform (DCT) analysis is a straightforward Fourier analysis tool which is sufficient for understanding the present invention. To use this tool the purge image data set is constructed over some range, a purge image tile, of image scanlines, j, and pixel locations, i, along these scanlines. When the purge image data set is implemented in the ink jet printer this purge image tile is replicated in both dimensions to create purge image date for the entire print image area. In this DCT analysis, the purge image is treated as a binary matrix of 1's for purge image dots to be printed and 0's if not Thus the purge image, over the range in scanlines, j, and pixel locations, i, is described as purge image data tile, $I_t(i,j)$. The purge image tile describes the physical image in X-Y space as a scattering of delta functions in i-j space.

For the examples hereinafter, a tile size of 100×100 is used. That is, the basic unit of the purge image data set is constructed as a matrix of 1's and 0's covering 100 scanlines and 100 pixel locations along these scanlines. This size has been chosen to analyze the preferred maximum gray level case of 1:100 dots in the printed purge image of any ink plane. Thus the purge image tiles constructed will have only one value of "i" for each value of "j" as a locations for purge image dots. That is, over the ten thousand pixel locations in the purge image tile, there are only one-hundred "1's" and only one "1" per scanline column "j". In general, the purge image tile size is preferably at least large enough along a scanline to create an area encompassing the purge image gray level, and also across an equal number of scanlines so as not to introduce higher frequency spatial information when replicated to form the full purge image data set. Therefore, if the minimum purge frequency indicates a needed grey level of $f_p/f_j$, then the tile size is preferably at least $f_j/f_p \times f_j/f_p$. Larger tile sizes may be advantageous in offering more options for elimination spatial artifacts, at the expense of having to store larger purge image data sets to characterize and replicate each purge image option.

The Discrete Cosine Transform (DCT) of the purge image tile, $I_t$ (i,j), is expressed as a matrix of coefficients C(p,q) representing the strength of the $p^{th}$ and $q^{th}$ cosine basis functions within the image. The purge image tile in X-Y space, expressed as the matrix $I_t(i,j)$ of pixels turned on or off, may be reproduced from the DCT cosine basis functions by adding them together, weighted by the C(p,q) coefficients. Large C(p,q) coefficients mean that the purge image tile pattern has large spatial frequency content at the (p,q) frequency. The C(p,q) coefficients are computed as follows:

$$C(p,q) = \alpha(p,q)\sum_{i=0}^{N-1}\sum_{j=0}^{N-1} I_t(i,j)\cos\left(\frac{(2i+1)p\pi}{2N}\right)\cos\left(\frac{(2j+1)q\pi}{2N}\right), \tag{7}$$

$$\text{where } \alpha(p,q) = \frac{1}{N} \text{ for } p,q = 0;$$

$$\frac{1}{2N} \text{ for } p,q = 1,2,\ldots N-1; \text{ and } N = 100$$

The DCT coefficient C(0,0) may be seen from Equation 7 to simply sum the purge image tile matrix over all pixel locations and then divide by N, i.e. C(0,0)=1.0. The C(0,0) coefficient represent a non-periodic, constant level term in the DCT. It essentially conveys the average gray level of the analyzed image tile, 1/100. The C(0,0) term will not be further discussed in the analysis of various purge image data tiles herein and it is artificially set to zero in subsequent graphical plots of the DCT because its magnitude would otherwise overwhelm the plotted amplitudes of the other spatial coefficients of interest.

Figure 5:
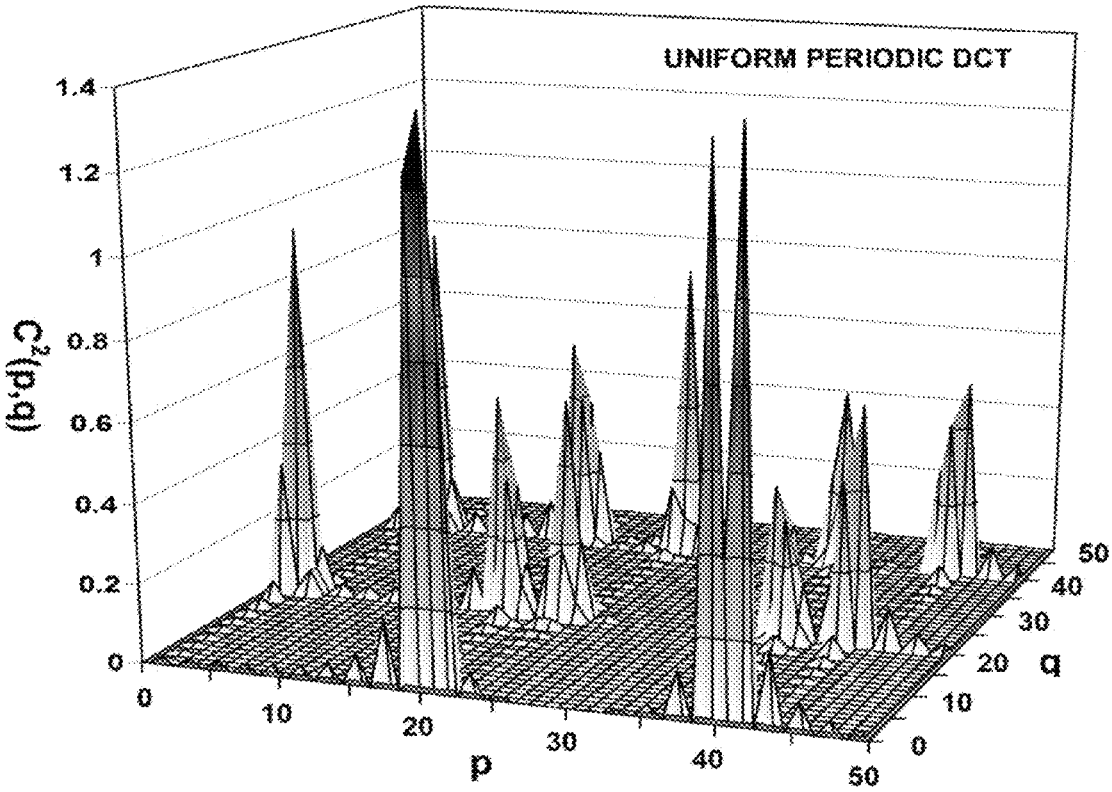
FIG. 5 depicts the Discrete Cosine Transform of periodic purge image data.

The DCT for a uniform periodic purge image tile is plotted in FIG. 5 with the C(0,0) coefficient set to zero. The periodic purge image tile, $I_{tper}(i,j)$ was generated for the maximum gray scale case of 1:100 purge image pixels to print image pixel locations. A purge image dot is specified for every $100^{th}$ pixel location for every scanline. The purge image dots are shifted ten pixel locations between every scanline. The result is that the print purge image is composed of single pixel dots on a uniform grid of 10×10 pixels along the X and Y pixel axes of the print image plane. The pixel locations, raster locations, are separated by addressability distance, D, along both axes for this example. This image has very strong spatial content at the spatial period ~10D.

DCT coefficients are both positive and negative, essentially allowing there to be phase differences among the cosine basis functions. Since it is the strength or power of the spatial content that is important to the HVS response, the square of the coefficients, $C^2(p,q)$, is plotted. This quantity will also be referred to as the spatial image power or intensity. The lowest frequency spatial components are found at the left corner of the p-q plane. It may be understood from Equation 7 that the arguments of the cosine basis functions are divided by (2N) so that small values of p and q represent small fractions of a period 2N. In X-Y print image space, 2N=200 D, i.e. the length of 200 pixel locations along a scanline or a distance of 200 scanlines across. Therefore, the very strong DCT coefficient power around p~20.5, q~0, is occurring for an X-Y space spatial frequency of ~(20.5/2N/D)=0.10/D=1/10 D. That is, the strongest spatial power in the printed periodic purge image is found to be at a spatial frequency of 1 cycle every 10 pixel locations, a clear consequence of the intentional design of $I_{tper}(i,j)$.

The DCT for the periodic purge image tile plotted in FIG. 5 was calculated only for (p,q) values up to 49. For the very low gray scale image patterns considered for purge image use, only lower spatial frequency components contribute significantly to any perception of a pattern. The spatial frequency basis function represented by (p=50, q=0) has a frequency of $(50/2N)D^{-1}$ in X-Y print image space, i.e. 0.25 $D^{-1}$. Equivalently, it represents a basis function at (0.25) times the pixel density. For a 1200 dpi image, this basis function is conveying the spatial image strength at (0.25×1200 dpi)=300 cycles/inch.

The periodic purge image depicted in FIG. 5 is satisfactory for use with the present invention in terms of having an acceptable gray level of 1/100 th. However, this type of structured, periodic placement of the purge image dots is not preferred because of the very strong spatial frequency content concentrated at 1/10 pixel frequencies along X and Y axes as well as additional very strong content at multiples of this frequency (p~40, q~0; p~20, q ~20; etc). Periodic patterns of purge image dots, having strong spatial content within the range of the HVS as characterized by the previously described CSF are not preferred for the practice of the present invention because the purge image dot pattern may be perceived by many observers.

Figure 6:
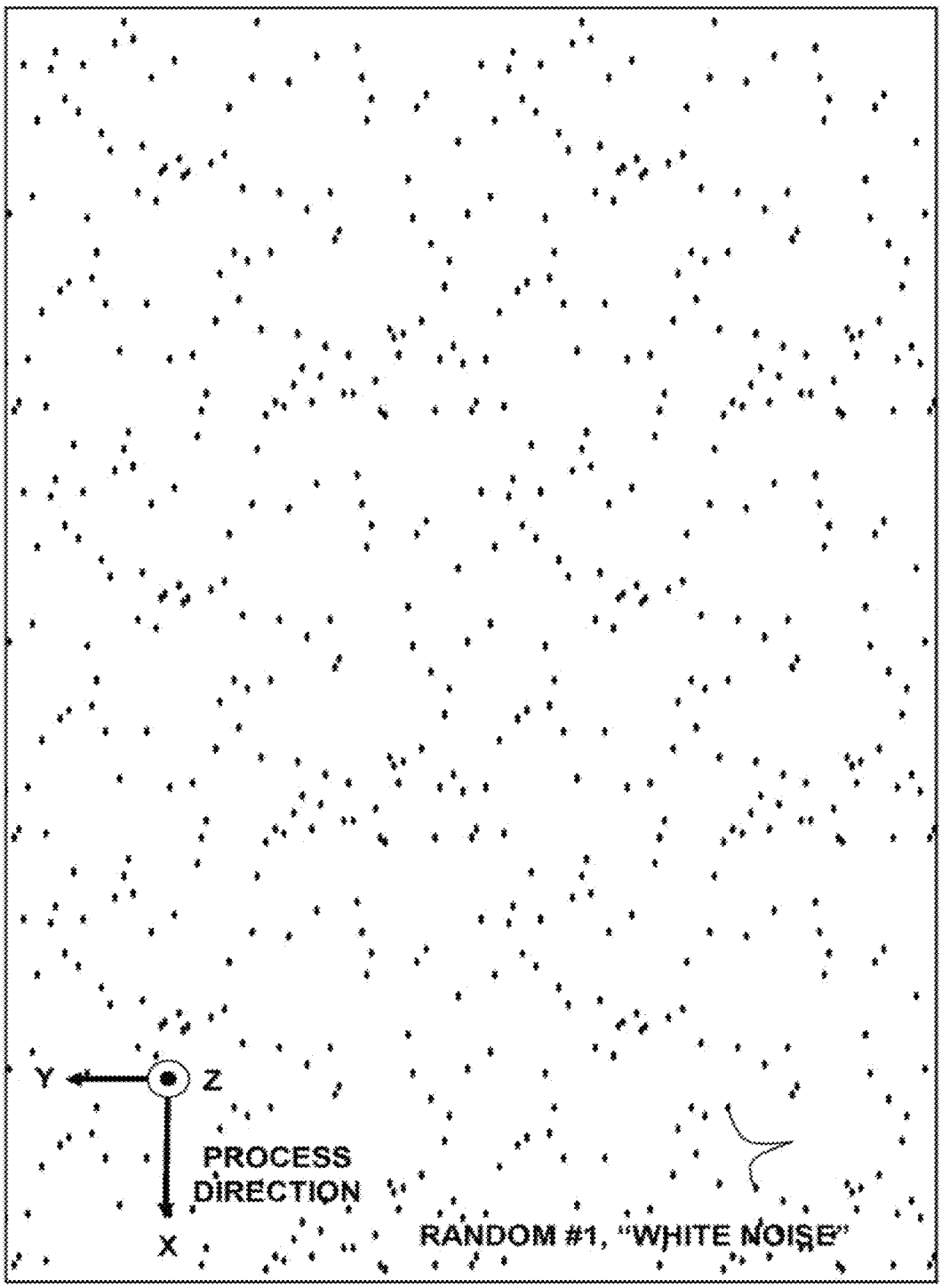
FIG. 6 depicts in an illustrative fashion a printed purge image pattern based on a random distribution of purge image dots.

A random placement of purge image dots may also be considered. Random patterns are also called "white noise" patterns and are characterized in DCT analysis by a uniform distribution of spatial frequency power across the DCT cosine basis functions. Random purge image tiles $I_{trnd}(i,j)$ were constructed in a 100×100 i-j matrix for the same gray level case (1/100 th of pixels printed) analyzed above for the periodic purge image tile design. The random image tiles were constructed by having a random number generator select a number between 0 and 99 for "i" for each scanline "j" between 0 and 99. One such random purge image data set, Random 1, is depicted in FIG. 6. In FIG. 6, the random purge image tile, $I_{trnd1}(i,j)$, has been replicated down the page in the process (X) direction three times and across the page twice. That is, FIG. 6 depicts and area of the printed purge image that is 300×200 pixels.

Figure 7:
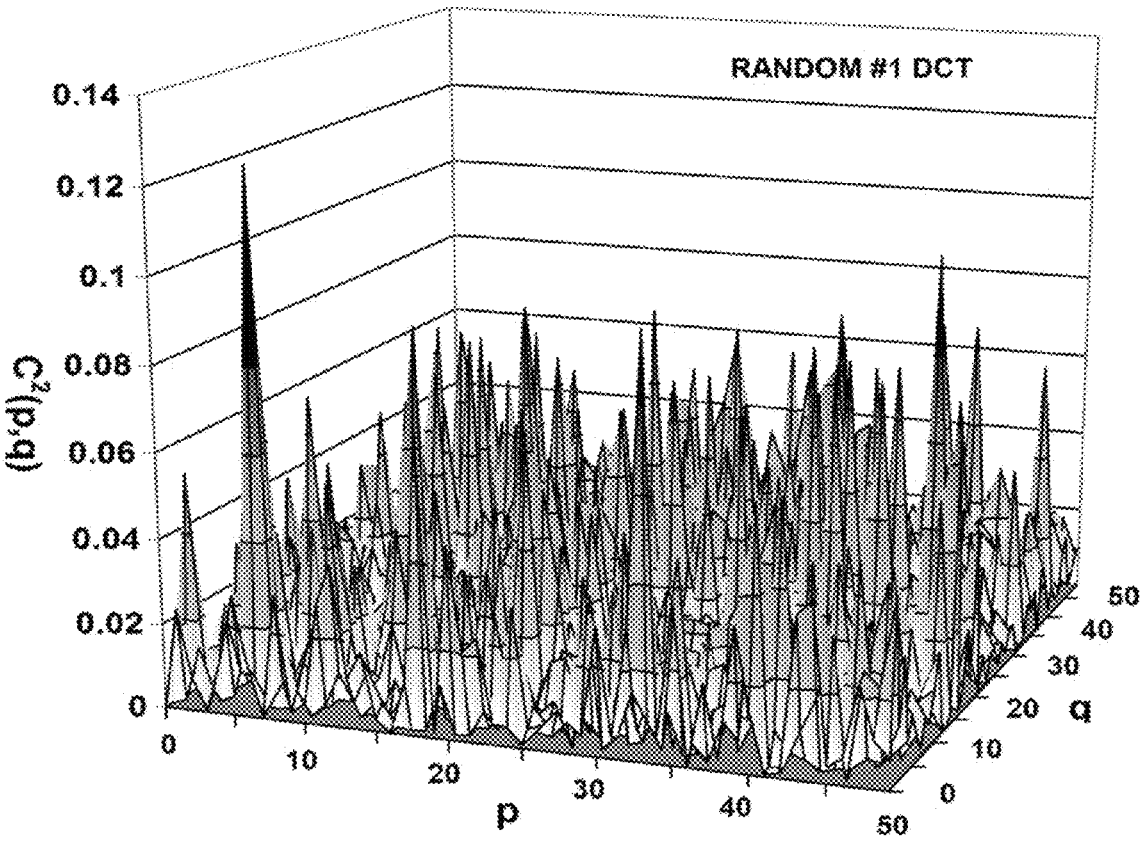
FIG. 7 depicts the Discrete Cosine Transform of the random purge image data tile printed in FIG. 6.

The DCT for $I_{trnd1}(i,j)$ is plotted in FIG. 7 in similar fashion to the DCT of FIG. 5 previously explained. A first significant difference between the DCT's of FIGS. 5 and 7 is that the maximum $C^2(p,q)$ values for the random purge image tile, FIG. 7, are an order of magnitude lower that the maximum values for the periodic purge image tile, FIG. 5. A second major difference is that the spatial frequency power is rather uniformly distributed over p-q space. These attributes both are important improvements over the periodic purge image in that they indicate an image that is significantly less perceivable. However, in viewing the random, "white noise", purge pattern it is also evident that there are noticeable low frequency, "worm-like" patterns of purge dots that have formed. This low frequency content, also seen in the DCT as some strong peaks in p-q space below (10, 10), is perceived by many observers in similar imaging artifacts present in stochastically screened digital halftones.

The problem of reducing perceptible spatial frequencies from purge image patterns is similar to the problem of developing stochastic halftone matrices that do not produce objectionable artifacts, such as "worms", in mid- and light tone areas of an image. Pioneering work in the area of stochastic screen design by Robert Ulichney has lead to the concept of modifying "white noise" patterns to remove perceptible, and objectionable, low noise components, resulting in a pattern having "blue noise" characteristics. The application of blue noise concepts to digital halftone screen design is explained in "Dithering with blue noise", Robert B. Ulichney, Proceedings of the IEE, Vol. 76, No. 1, January 1988.

While there are several approaches to constructing a blue noise pattern, one method that is conceptually straightforward to understand is the "void and cluster method", described in the context of digital halftone screen design in U.S. Pat. No. 5,535,020 to R. Ulichney on Jul. 9, 1996, Ulichney '020 hereinafter. The construction of a blue noise purge image pattern is different from the halftone dither matrices disclosed in Ulichney '020 because purge image data tiles are constrained to have a necessary number of print dots assigned to each image scanline, whereas the halftone dither matrix designer may move pixels around the dither matrix freely without regard to achieving a minimum purge frequency per jet via the scanline pixel densities.

The void and cluster design method described in Ulichney '020 consists of examining a starting pattern, for example the random pattern depicted in FIG. 6, for the closeness of halftone dots to every point in the halftone dither matrix. The halftone dot that is located closest to the most other dots, the most "clustered" dot, is moved to the dither matrix position having the least proximity to halftone dots, the "biggest void". The process is iterated until moving the most clustered dot to the biggest void produces no change in the pattern.

A related process was carried out to develop purge image data tiles having blue noise characteristics. Beginning with $I_{trnd1}(i,j)$, the inverse distances of the nearest 100 purge image dots to each purge image dot within the tile was calculated and summed as a figure of merit of closeness for that purge image tile pixel. That is, for each purge image "1" located at position (m,n) in the $I_{trnd1}(i,j)$ matrix, the closeness merit function, M(m,n) was calculated as follows:

$$M(m,n) = \sum_{j=m-50}^{j=m+50} \sum_{i=n-50}^{i=n+50} I_{trnd1}(i,j) \frac{1}{(m-j)^2 + (n-i)^2}, \quad j \neq m,\ i \neq n. \tag{8}$$

For the purpose of this calculation the purge image tile data is replicated in both "i" and "j" directions so that the nearest purge image dot in each scanline, within the 50 nearest scanlines, is included in the summation indicated in Equation 8. Closeness merit function M(n,m) returns an estimate of the closeness of other purge dots weighted by the square of the distance. That is, contributions to the sum in Equation 8 fall off as the square of the distance away from the (m,n) dot. When closeness merit function M(m,n) is applied to the periodic image purge data tile, $I_{tper}(i,j)$, it is found that all purge dots are equally close to other purge dots, i.e. M(m,n)=0.1340.

Figure 8:
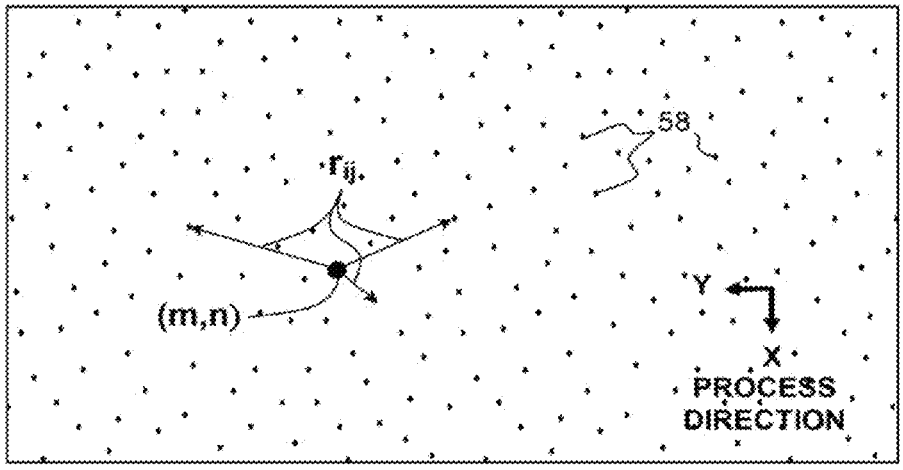
FIG. 8 depicts the vectors in X-Y space that are used to calculate the closeness merit function.

The distance vectors summed in M(m,n) are depicted in FIG. 8. The inverse distances squared, $r_{ij}^{-2}$, to nearby purge image dots 58 from a dot (m,n) are summed. The example purge image data tiles calculated have 100 purge image dots, one per scanline. The closeness merit function M(m,n) is plotted for some purge image data tiles in FIG. 9 as a scatter plot, one plot symbol for each of the dots in the 100 scanlines. The "m" value for this plot is whatever value of m specifies the one purge dot for the nth scanline. The n value corresponds to both a scanline and a jet for the simple case of a single pass imaging mode.

Figure 9:
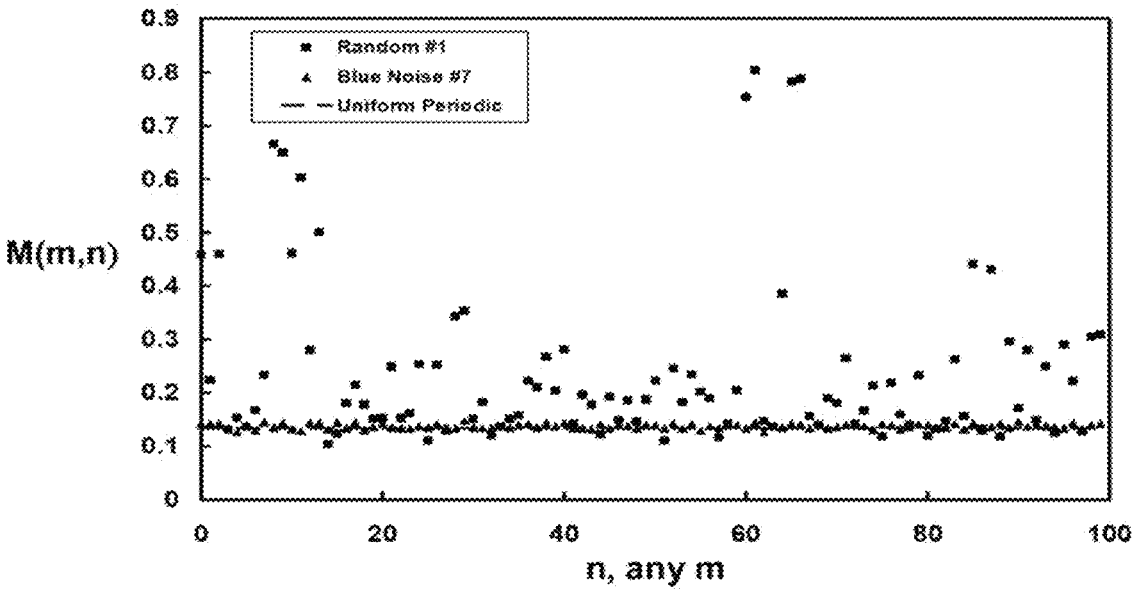
FIG. 9 depicts closeness merit function calculation results.

The M(m,n) function for the uniform periodic purge image data tile $I_{tper}(i,j)$ is plotted in FIG. 9 as a dashed line at 0.134, largely obscured by other data points. The M(m,n) result for the random purge image data tile $I_{trnd1}(i,j)$ is plotted as square symbols on FIG. 9. The large scatter of this plot data shows the great variability in clustering for the "white noise" pattern. The M(m,n) function for a blue noise pattern is plotted as triangle symbols in FIG. 9. The closeness merit function for a blue noise pattern exhibits the result of applying a "void and cluster" type process for adjusting dot positions until all purge image dots are nearly equally distant from every other purge image dot.

Figure 10:
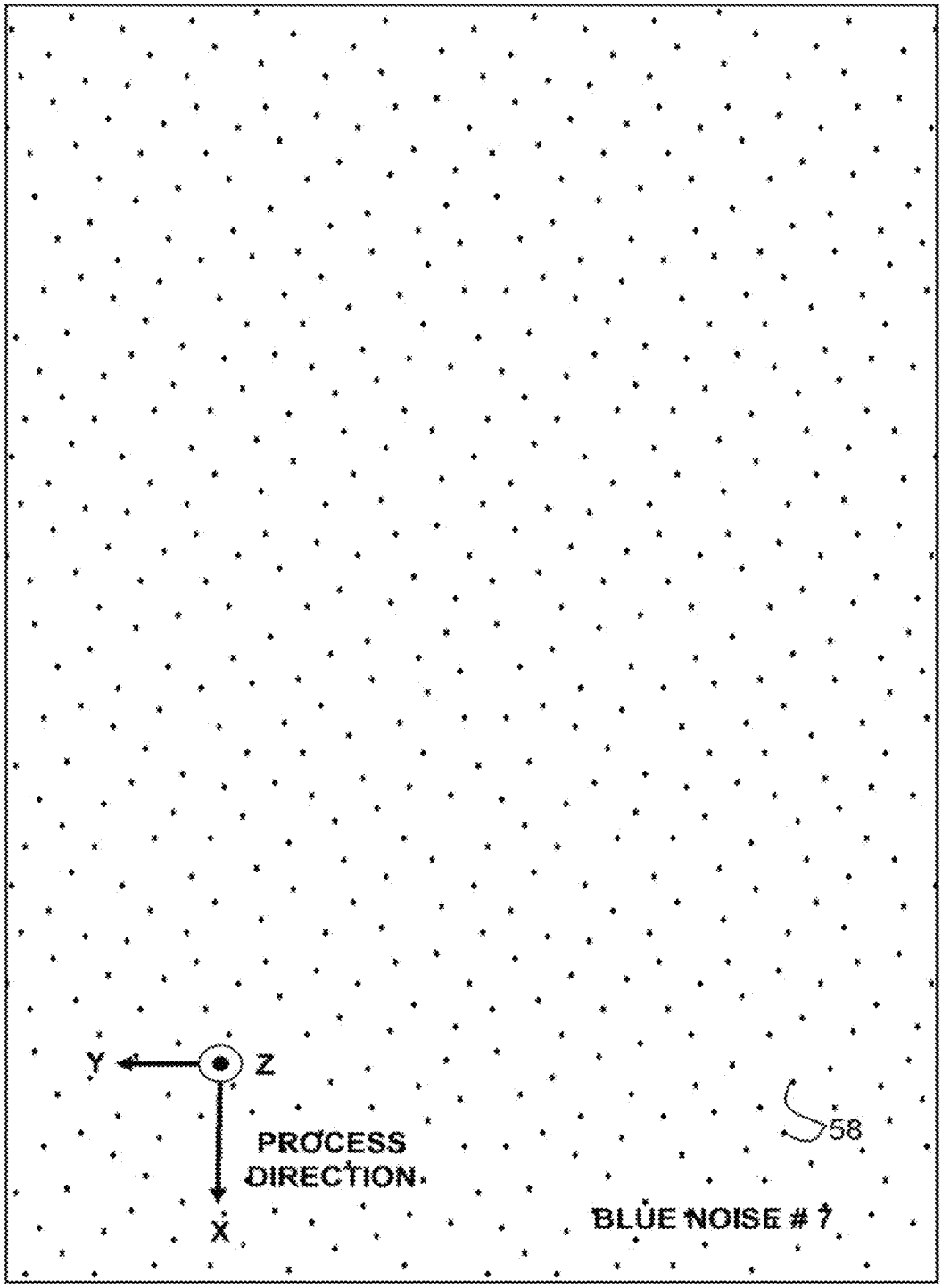
FIG. 10 depicts in an illustrative fashion a printed purge image pattern based on a blue noise distribution of purge image dots.

The blue noise pattern associated with the closeness merit function plot in FIG. 9 is depicted in FIG. 10. FIG. 10 depicts a 100×100 blue noise purge image data tile, $I_{tbn7}(i,j)$, replicated thrice in the process direction and twice in the Y direction, i.e. 300×200 pixels of a printed blue noise purge image are shown. As for the other examples, the blue noise pattern is for a 1/100 th gray level and there is one purge image dot per scanline in the 100×100 data tile. The $I_{tbn7}(i,j)$ purge image data tile was constructed from the $I_{rnd1}(i,j)$ data tile guided by results, in stages, from the closeness merit function calculated at each stage. This procedure was carried out "by hand", however, machine computational methods described in Ulichney '020 could be adapted to this task. The Blue Noise 7 data tile depicted in FIG. 10 was constructed in 7 stages removed from the Random 1 purge image data tile wherein the ten purge dots having the highest calculated closeness (M(n,m) value) were moved within their scanline to pixel locations appearing to have greater "void" space judged by the pattern appearance itself. It was found that very little improvement in the uniformity of the closeness merit function could be obtained after approximately 5 iterations of the pattern.

The Blue Noise 7 purge image depicted in FIG. 10 is readily seen to be greatly superior to either a periodic purge image or a white noise purge image, FIG. 6, in the sense of being uniform and featureless. If FIGS. 6, and 10 are viewed from increasing distances that bring the printed patterns close to an actual intended size, it may be seen that the blue noise pattern disappears first. That is, the blue noise pattern is the least perceptible.

Figure 11:
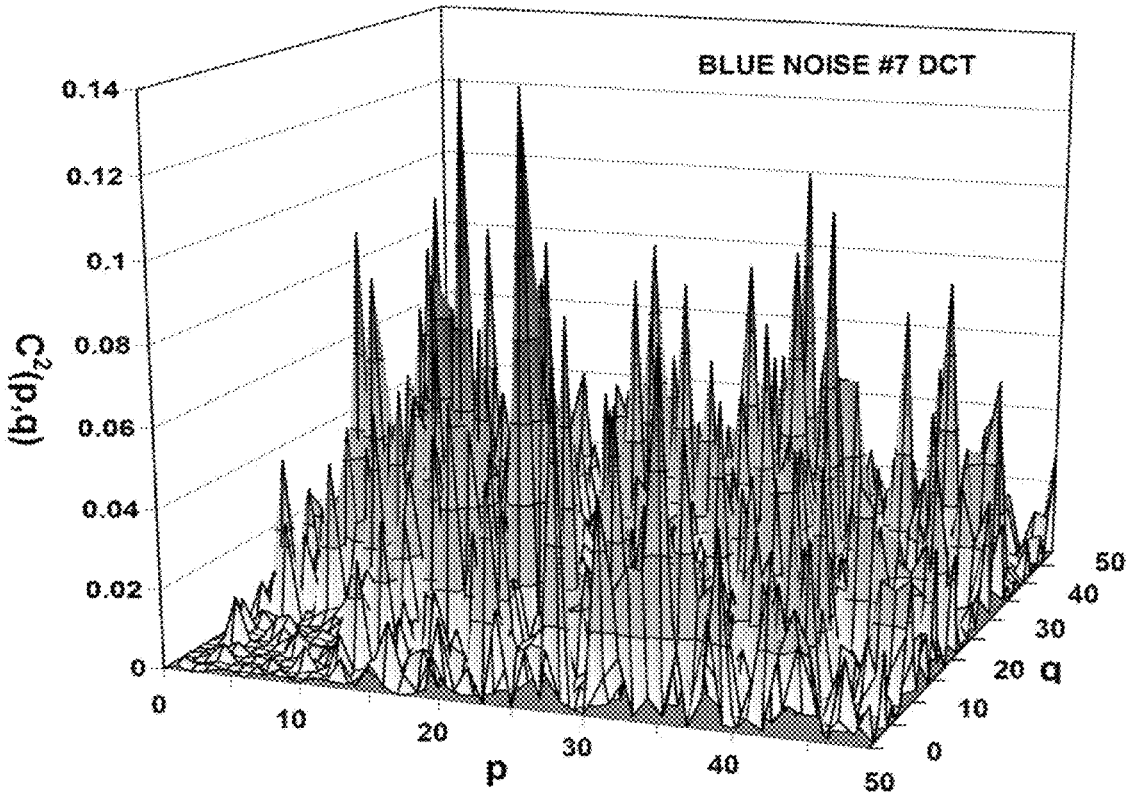
FIG. 11 depicts the Discrete Cosine Transform of the blue noise purge image data tile printed in FIG. 10.

The DCT for the Blue Noise 7 purge image data tile, $I_{bn7}(i,j)$, is plotted in FIG. 11. Comparing the Blue Noise 7 DCT, FIG. 11, to the white noise Random 1 DCT, FIG. 7, the following may be observed. The spatial frequency power generally has the same peak magnitudes and is distributed in similar fashion for both patterns at higher spatial frequencies, i.e. for p and q values above ~30. The primary difference is that spatial image power has been shifted away from the lowest frequencies in the white noise pattern, FIG. 7, to a ring in p,q space located a distance ~20 units from (0,0) for the blue noise pattern. Substantial reduction of image power out of low spatial frequencies, while retaining white noise characteristics at high frequencies, results in the desirable HVS responses of perceived image uniformity and featurelessness. This is a primary characteristic of a blue noise purge image that will be further elaborated below with the introduction of radial average DCT coefficient analysis.

Figure 12:
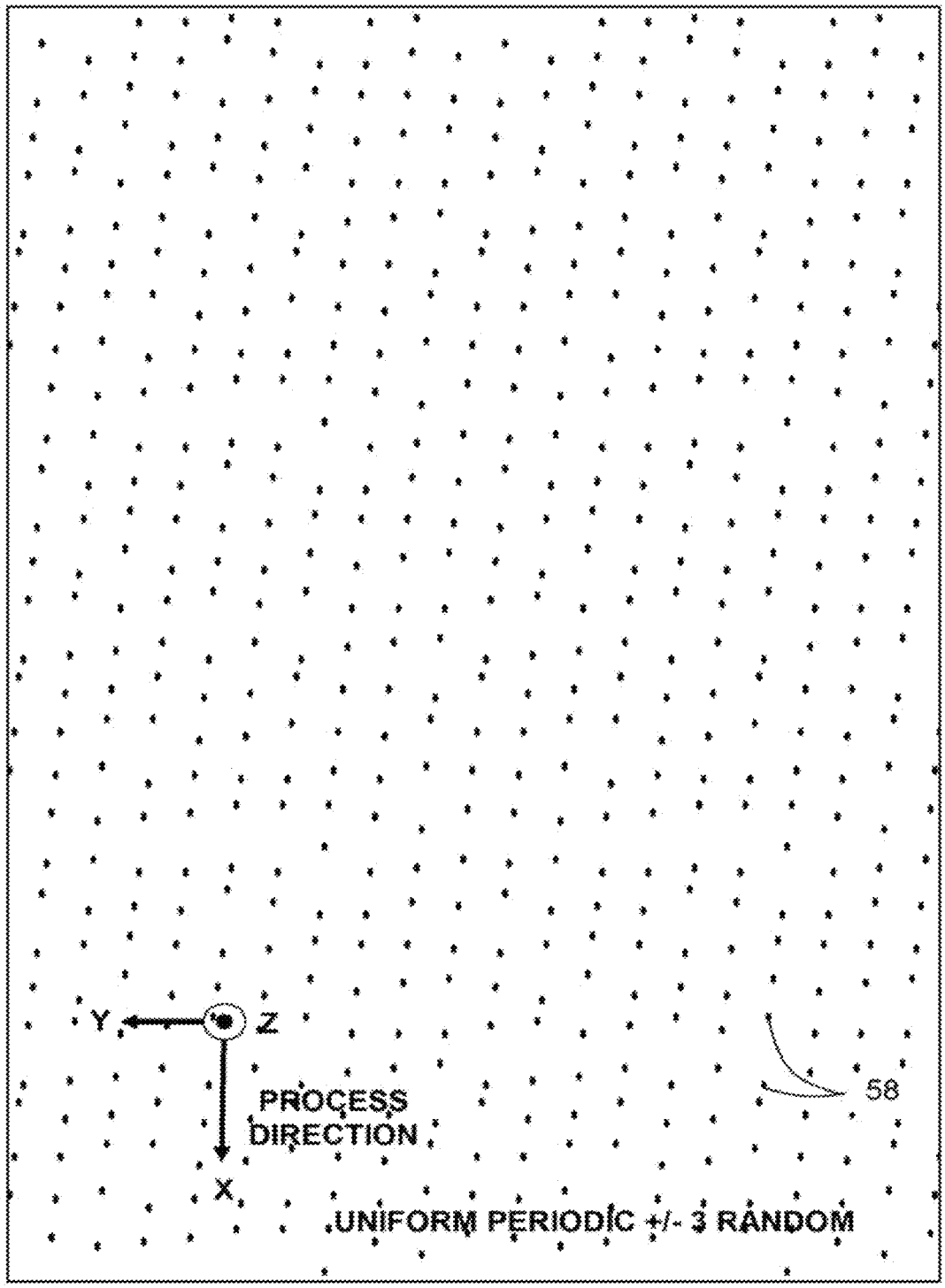
FIG. 12 depicts in an illustrative fashion a printed purge image pattern based on a randomized periodic distribution of purge image dots.
Figure 13:
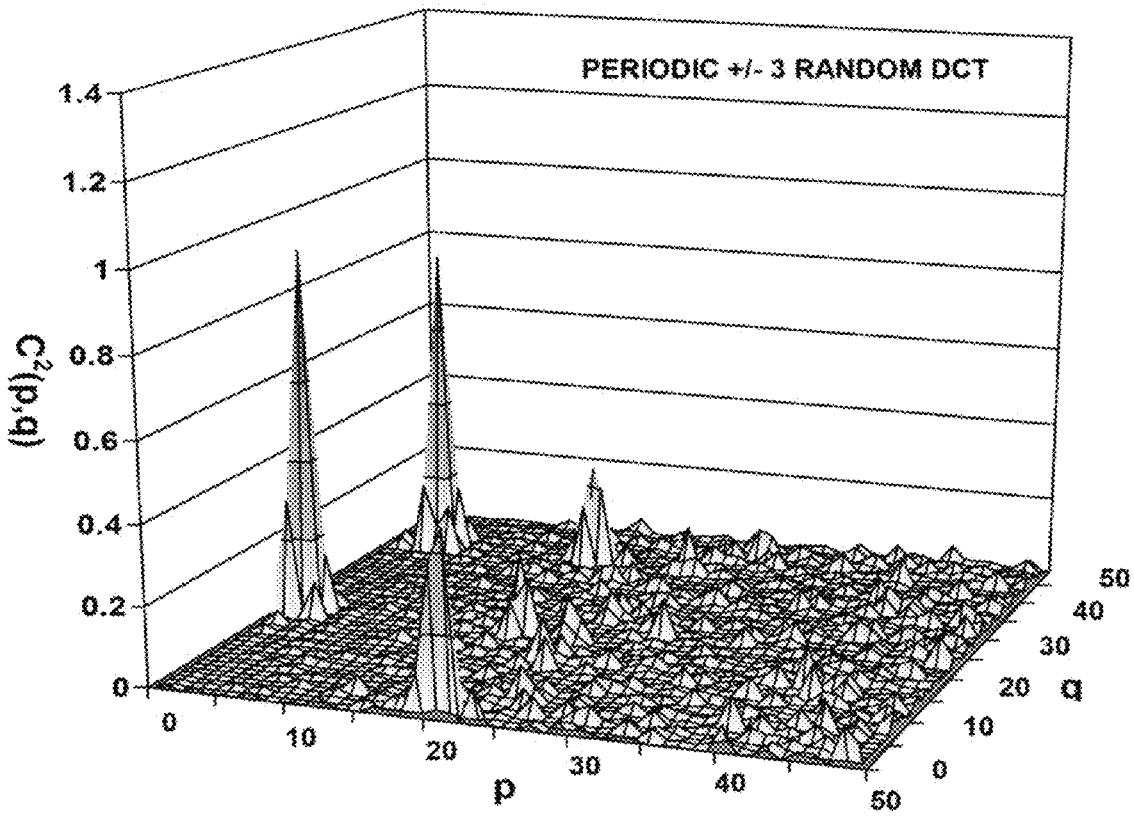
FIG. 13 depicts the Discrete Cosine Transform of the randomized periodic purge image data tile printed in FIG. 12.

Before turning to radially averaging the results of DCT calculations it is useful to view and analyze another alternative construction approach for the purge image, adding white noise to a periodic pattern. The purge image pattern depicted in FIG. 12 was constructed from the uniform periodic purge image data tile by shifting purge image dot on each scanline up to ±3 pixel locations along that scanline. As before, FIG. 12 shows the Randomized Periodic purge image data tile, $I_{trper}(i,j)$ replicated thrice in the process direction and twice in the Y direction. The DCT for this purge image data tile is plotted in FIG. 13. The DCT in FIG. 13, and the printed purge image depicted in FIG. 12 illustrate that it is not enough to simply add white noise to a periodic pattern, even though this does add white noise to higher frequencies and retain very low image power at very low frequencies. Both of these beneficial characteristics, which contribute to the imperceptibility of a blue noise pattern, are still overwhelmed by strong components that are an order of magnitude higher than the general level of most frequency components. The strong remaining periodic nature of the pattern is evident from viewing FIG. 12.

Figure 14:
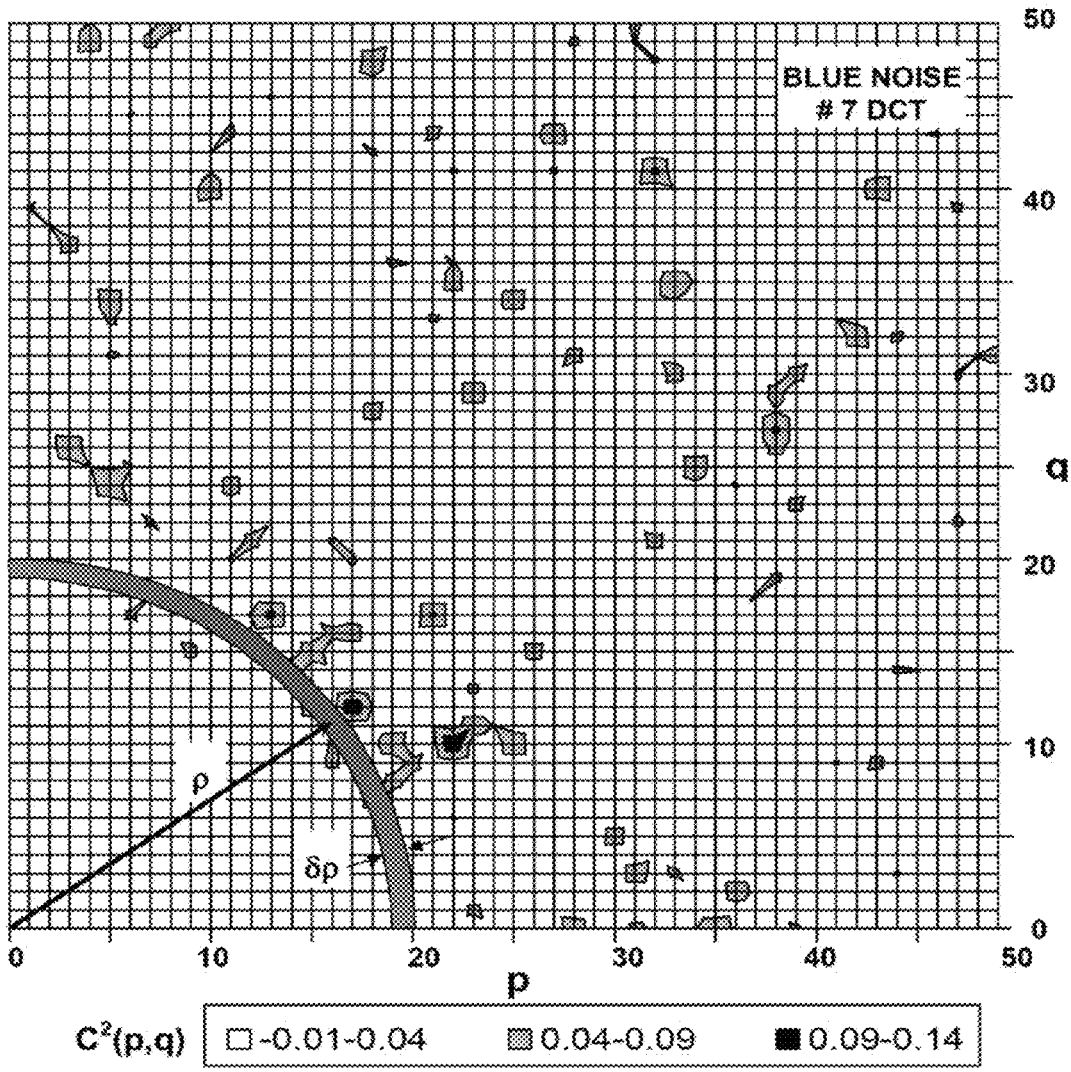
FIG. 14 depicts a contour plot of the Discrete Cosine Transform of the blue noise purge image data tile printed in FIG. 10.

Additional understanding of the important characteristics of a blue noise purge image may be gained by collapsing the two dimensional DCT frequency space into a single radial value for p and q. FIG. 14 shows the Blue Noise 7 DCT plotted in FIG. 11 collapsed into a contour plot in p-q space. Only a few contours of the data are shown. Superimposed on the contour plot is a radius vector, p, and an annulus of width δp. A radially averaged power spectrum is formed by averaging the $C^2(p,q)$ values of the DCT within an annulus of width δp at each value of the radius $\rho=(p^2+q^2)^{1/2}$. A simplified radially averaged power (RAP) spectrum, RAP(ρ), was calculated by averaging the $C^2(p,q)$ values for all cells in the 50×50 DCT p-q space that fall within an annulus, δρ=1, centered for each unit value of ρ,ρ=0, 1, 2, . . . . The value of RAP (0) is artificially set to 0 as was done for the DCT plots.

Figure 15:
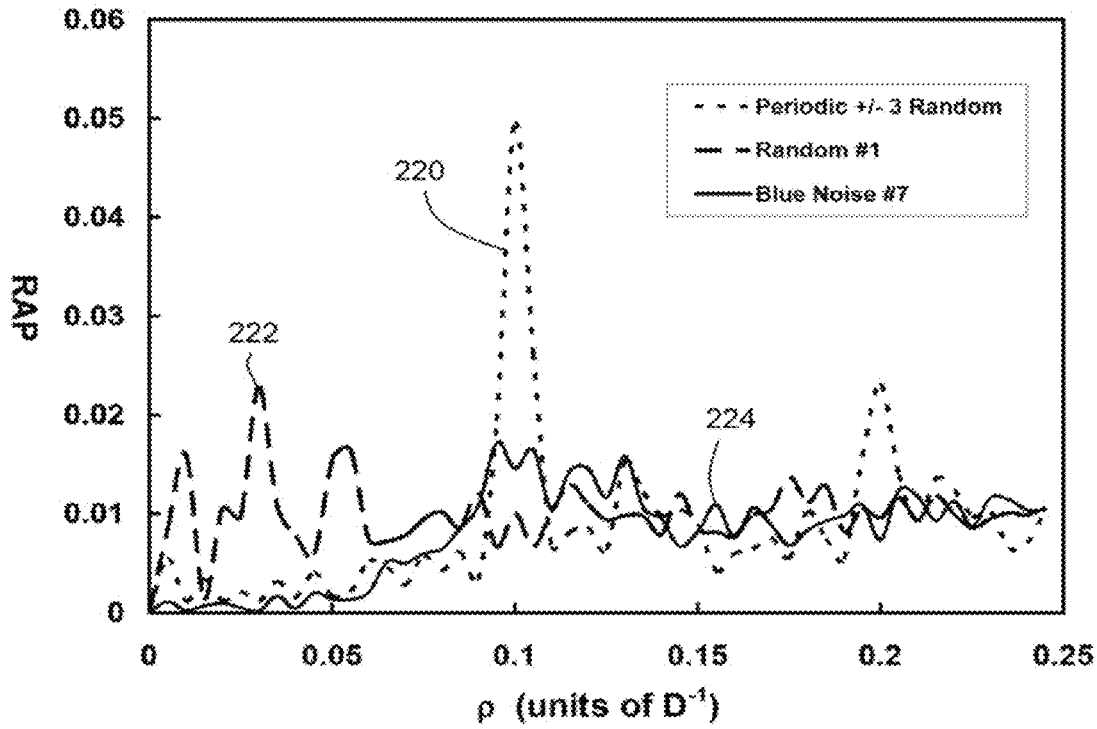
FIG. 15 depicts some calculations of radially average power spectrums.

RAP(ρ) calculations for three purge image data tiles are plotted in FIG. 15. Plot line 220 is for the Randomized Periodic case, plot line 222 for the Random 1 white noise case, plot line 224 is for the Blue Noise 7 case, all previously discussed. The units of the radius axis have been converted into units of $D^{-1}$. The RAP plots show the characteristics of a preferred blue noise purge image data set to have the following characteristics:

(1) a slight maximum (less than twice the overall average power) in the radially averaged power spectrum located at the square root of the gray level, $\rho_{max}=\sqrt{G}$ (for the purge image data cases plotted, the gray level is G=1/100, and $\rho_{max}=\sqrt{G}=0.1$);

(2) substantially reduced RAP below the frequency of the spectrum maximum;

and (3) uniformly distributed power at frequencies above the spectrum maximum.

White noise and randomized periodic purge image data designs have some, but not all, of the characteristics of blue noise. They either have too much spatial intensity at very low frequencies (white noise), or concentrate too much spectral power in narrow harmonic bands (randomized periodic).

Figure 16:
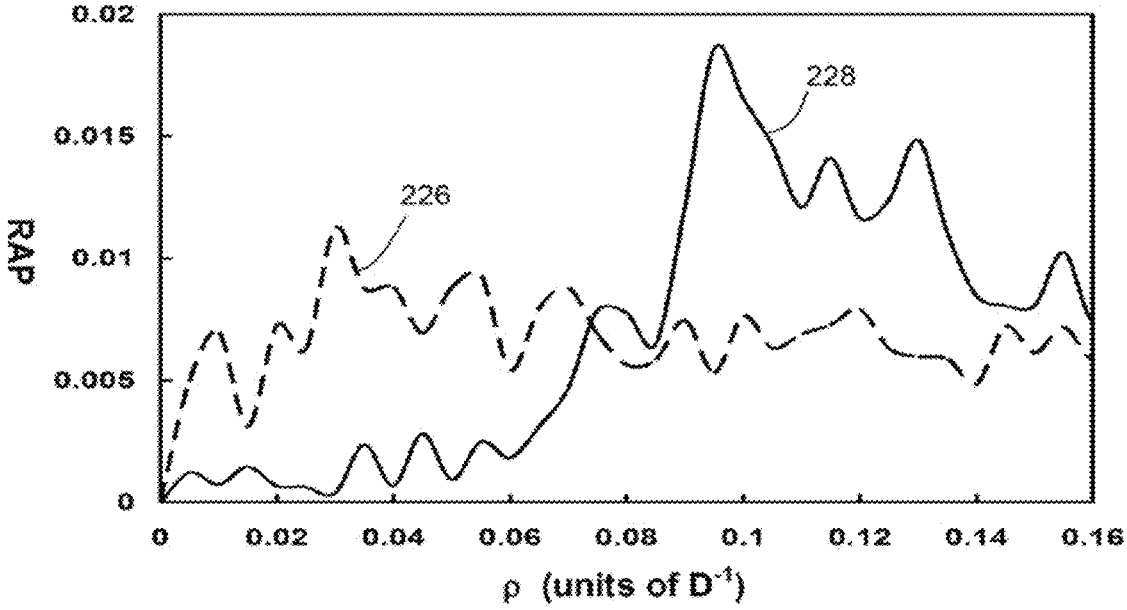
FIG. 16 depicts a comparison of the radially averaged power spectrums for a blue noise purge image data tile and a white noise purge image data tile.

The white noise RAP and blue noise RAP calculations are plotted as plot lines 226, 228 respectively in FIG. 16 to better understand the differences between these to types of purge image data sets without the higher peak magnitude randomized periodic curve. The primary beneficial effect of shifting purge image dots from their positions in the white noise, Random 1, purge image data tile $I_{trnd1}(i,j)$ to their positions in the Blue Noise 7 purge image data tile $I_{bn7}(i,j)$ was to shift imaging power from low frequency components to a spatial frequency area that averages the separation among purge dots, i.e. to $\rho_{max}=\sqrt{G}=0.1$.

The above discussion describe methods of construction of purge image data sets from smaller tiles that are sized, at least to correspond to the gray level dictated by a minimum purge frequency. Purge image data sets for multi-pass applications may be constructed in similar fashion except that the data tiles must be populated with enough pixels for each scanline for each pass and be shifted according to the print mode masks. For example, if a four pass purge image is needed, then the 100×100 data tiles constructed above are converted into 400×400 patterns that, after four passes, are equivalent to a 100×100 grey level in the final image. Printing in 4-pass mode therefore requires the minimum purge frequency to print frequency be four times smaller than for a 1:100 case. That is, the purge image data will cause the printhead to print a purge image of gray level 1/400 within each swath for each pass.

The total purge image mask is constructed at the 1/100 level rather that at the 1/400 level, to eliminate artifacts that would be caused by simply repeating the same 1/400 purge image data set for each swath. One of the advantages of the methods of the present invention is that the off line construction of such multi-pass purge image data sets allows any artifacts to be eliminated by use of Fourier analysis tools and viewer testing and then stored in image data form. The purge image data set is thereby coordinated with the print mode without having to make alignment and timing calculations in real time.

Figure 17:
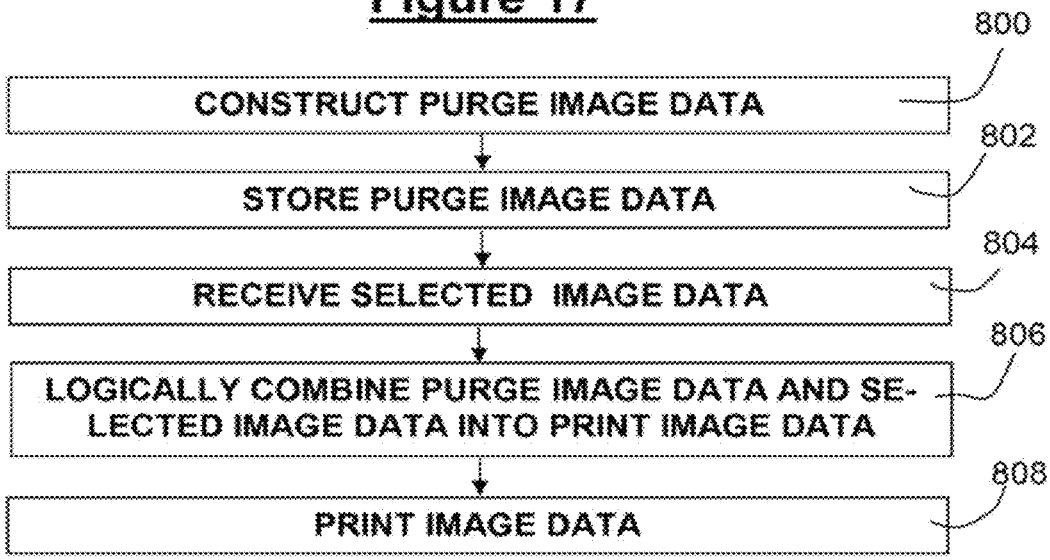
FIG. 17 depicts a flow diagram of preferred methods of the present invention.
Figure 18:
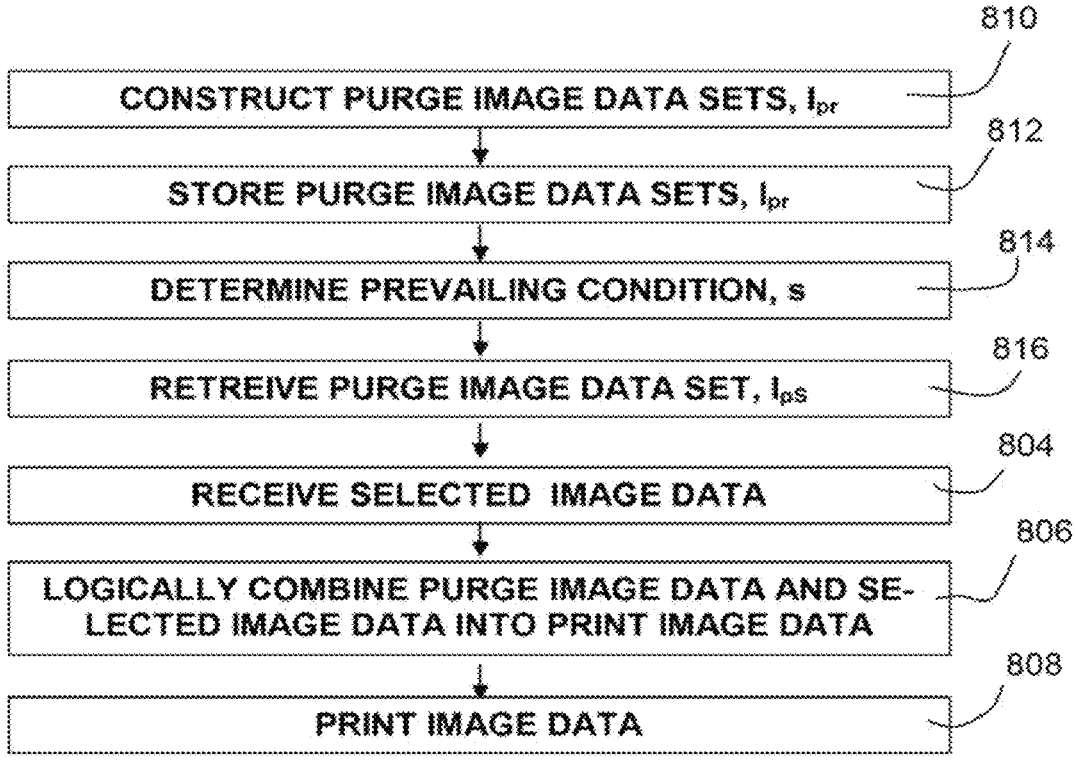
FIG. 18 depicts a flow diagram of additional preferred methods of the present invention.
Figure 19:
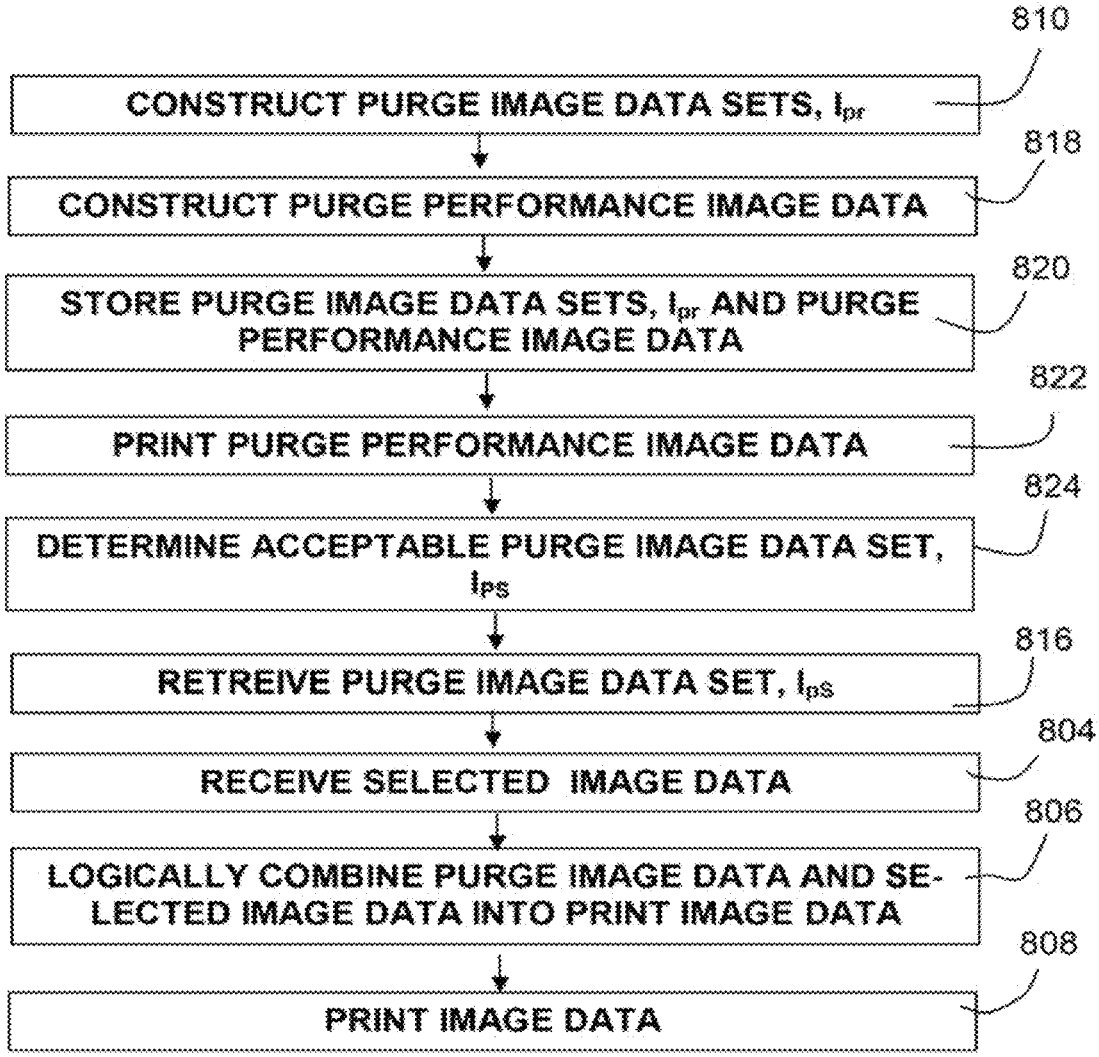
FIG. 19 depicts a flow diagram of further preferred methods of the present invention.

The methods of the present invention are illustrated diagrammatically in FIGS. 17-19. There are several common elements to all of the preferred methods beginning with a step 800 of constructing a purge image data set, a step 802 of storing the purge image data where they are accessible to a controller. Then, after user selected image data is received at step 804, the purge image data set is logically combined with the selected image data to form a print image data set at step 806 that is then printed by the ink jet printhead onto a print media at step 808. The purge image data set contains sufficient numbers of designated purge image dots to assure that each jet will be directed to eject drops a minimum number of times during the printing of the image. This form of the present inventive methods is diagrammed in FIG. 17.

For the preferred methods diagrammed in FIG. 18, a plurality of purge image data sets is constructed at step 810 to provide different numbers or patterns of purge image dots to address different conditions that may prevail. For example, different inks may be loaded, different environmental temperatures may occur, or different print modes may be selected while operating the ink jet printing apparatus. The plurality of purge image data sets is stored at step 812. Then, at step 814 a determination is made as to which of the plurality of conditions prevails, designated condition s. The purge image data set, $I_{ps}$, which corresponds to the determined condition s, is retrieved at step 816. The methods then proceed as for those discussed above with respect to FIG. 17.

Figure 20:
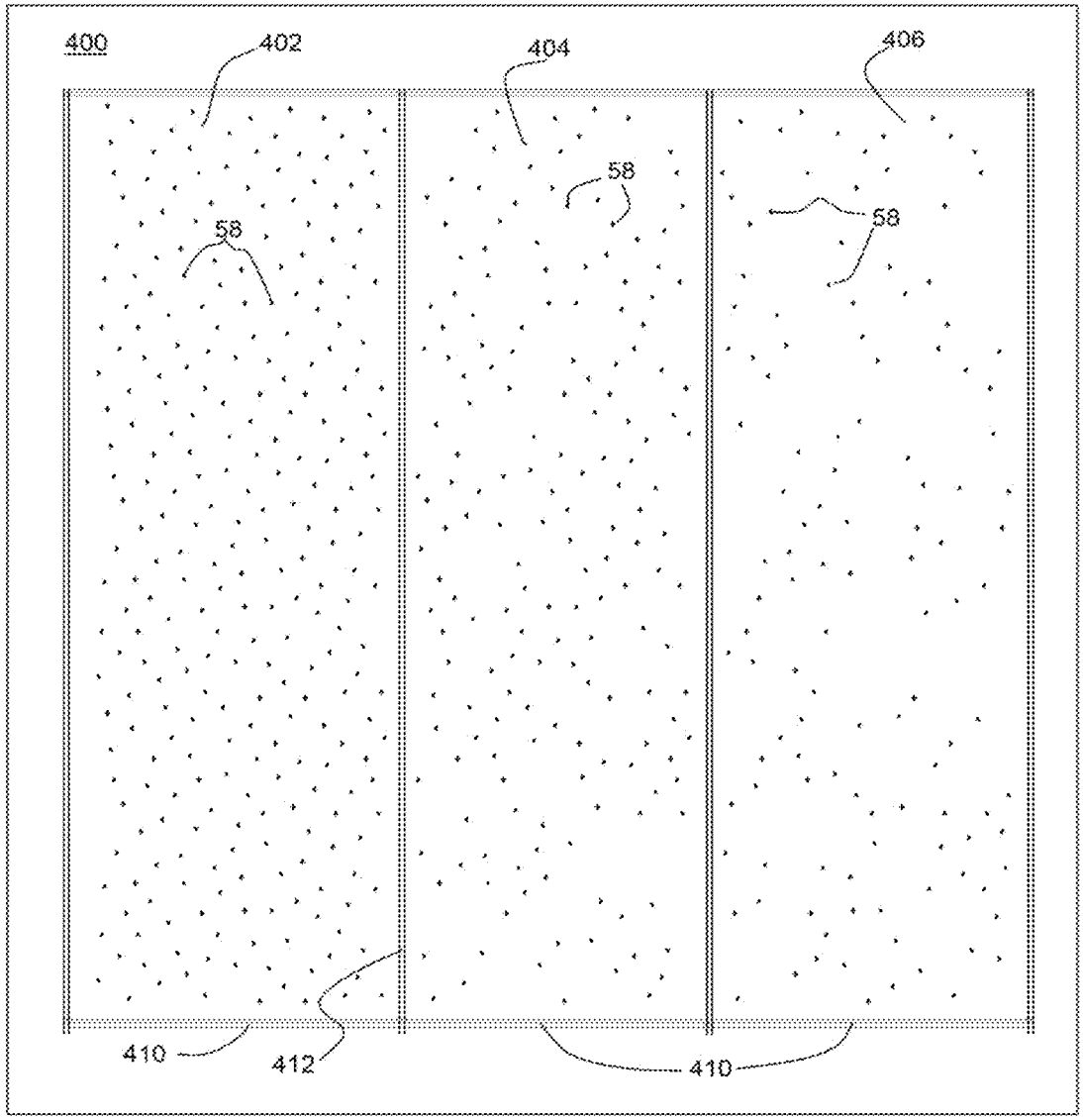
FIG. 20 depicts an illustrative example of a printed purge performance image data set used as a test target.

For the preferred methods diagrammed in FIG. 19, a plurality of purge image data sets is constructed at step 810 to provide different numbers of purge image dots to address different conditions that may prevail. Then, at step 818, a purge performance image data set is prepared which combines purge image data from the plurality of purge image data sets as well as test patterns that are sensitive to the state of maintenance of the plurality of jets. For example, a series of single pixel lines at single pixel spacing will show printing defects if drops to print these lines are ejected from jets that have not been sufficiently fired beforehand. FIG. 20 illustrates a printed purge performance image example that combines portions of three different purge image data sets 402, 404, and 406 that precede, in the process direction, a set of single pixel lines 410. Boundary lines 412 delineate the different purge image data sets. In this example, purge image data set 402 is a 1/100 grayscale pattern, purge image data set 404 is a 1/200 gray level pattern and purge image data set 406 is a 1/300 gray level pattern. Purge performance image data sets may be constructed to facilitate measurement by optical scanner 190 (in FIG. 1), by a human observer, or both.

In step 824 the printed purge performance image is measured or observed to help determine an acceptable purge image data set for subsequent use in maintaining printhead performance. In the example purge performance test image illustrated in FIG. 20 the fine line portion 410 may be measured for optical density, or some measure of line raggedness, or examined by eye or with a printer's magnifier loop for each region following the three different levels of purge drop density, 402, 404, or 406. Ordinarily, the purge drop data set having the lowest gray level which results in satisfactory printing of the sensitive target area would be selected.

Steps 816, 804, 806 and 808 proceed as for the above methods illustrated in FIGS. 17 and 18.

The purge image data can be in any usable form such that the printer controller system can logically combine it with the image data to produce the combined image. The purge image may be stored in compressed form and is decompressed before logically combining the purge image data and the selected image data.

There are several embodiments of preferred methods of the present invention that follow the same steps as diagrammed in FIGS. 17-19 wherein the purge image data sets are constructed according to different criteria. There are numerous embodiments of the preferred methods of the present invention wherein the ink jet printhead and print media are moved relative to each other in a single pass in the process direction. There are also numerous embodiments of the methods of the present invention wherein the ink jet printhead and media are moved in multiple overlapping passes interleaved with subscan advances to form the print image.

The invention has been described in detail with particular reference to certain preferred embodiments thereof, but it will be understood that variations and modifications can be effected within the spirit and scope of the invention.

The invention claimed is:

1. A method for maintaining a plurality of ink jets used in a printing apparatus that forms a selected ink image on a print medium by relatively moving the plurality of ink jets and the print medium in a process direction while ink drops are ejected by the plurality of ink jets, the printing apparatus forming a selected ink image in response to selected image data specifying the deposition of ink dots at selected predetermined pixel locations on a plurality of image scanlines aligned with and extending in the process direction a predetermined image length on the print medium, the method comprising the steps of:

(a) constructing purge image data that specifies the deposition of at least one ink dot on at least one predetermined pixel location on each of the plurality of image scanlines within the predetermined image length;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium and wherein the print medium has an average base optical density, the purge image data specifies a printed purge image of substantially uniformly distributed ink dots along and among the image scanlines, and the printed purge image has an average purge image optical density less than about 0.01 OD above the print medium average base optical density.

2. The method of claim 1, wherein the ink dots formed on the print media have an average diameter of less than about 50 microns.

3. The method of claim 1, wherein the ink drops have an average volume of less than about 12 picoLiters.

4. The method of claim 1, wherein the print medium is a textile and the ink drops have an average volume of less than about 40 picoLiters.

5. The method of claim 1, wherein the plurality of ink jets comprises an ink jet printhead that is stationary during the printing of the print image data.

6. The method of claim 5, wherein the plurality of ink jets includes at least one jet aligned with each image scanline.

7. The method of claim 5, wherein there is a minimum steady state drop purging frequency, $f_p$, that is required to maintain a desired ink drop volume and velocity ejected from the plurality of ink jets, the print medium is moved the predetermined image length in a print time, $T_p$, the purge image data is constructed so that ink dots are specified for at least $N_p$ predetermined pixel locations on each of the plurality of image scanlines within the predetermined image length, wherein $N_p \geqq f_p T_p$.

8. The method of claim 1 wherein the purge image data is constructed by tiling a purge image matrix that specifies dot locations for at least 100 predetermined pixel locations along 100 image scanlines.

9. A method of claim 1 where the printing apparatus is a carriage printer where the printheads relatively move in a sub-scan direction traverse to the process direction so that each of the plurality of jets are aligned with a plurality of image scanlines while forming the selected ink image.

10. The method of claim 9, wherein the print medium is in the form of a cut sheet mounted on a circulating surface for movement relative to the plurality of ink jets in the process direction and the predetermined image length is substantially equal to the length of the cut sheet in the process direction.

11. The method of claim 9, wherein each image scanline is traversed by a plurality of complementary jets during a plurality of process direction relative movements wherein the selected image data is masked so that for each image scanline, complementary predetermined pixel locations are assigned for ink dot deposition to complementary jets that traverse the image scanline, and the purge image data is constructed so that at least one ink dot is specified for at least one complementary predetermined pixel location assigned to each complementary jet for each image scanline.

12. The method of claim 9 wherein the purge image data is constructed by tiling a purge image matrix that specifies dot locations for at least 100 predetermined pixel locations along 100 image scanlines.

13. A method for maintaining a plurality of ink jets supplied with a plurality of inks of different types, used in a printing apparatus that forms a selected ink image on a print medium by relatively moving the plurality of ink jets and the print medium in a process direction while ink drops of the different types are ejected by the plurality of ink jets, the printing apparatus forming a selected ink image in response to selected image data specifying the deposition of ink dots of the different types at selected predetermined pixel locations on a plurality of image scanlines aligned with and extending in the process direction a predetermined image length on the print medium, the image scanlines further associated with one or more of the plurality of ink types, the method comprising the steps of:

(a) constructing purge image data that specifies for each scanline, the deposition of at least one ink dot of each ink type associated with that scanline on at least one predetermined pixel location within the predetermined image length;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium and wherein the print medium has an average base optical density, the purge image data specifies a printed purge image of substantially uniformly distributed ink dots along and among the image scanlines, and the printed purge image has an average purge image optical density less than about 0.01 OD above the print medium average base optical density.

14. The method of claim 13 wherein the different types of inks are different colors of inks.

15. The method of claim 13 wherein the different types of inks are inks having a same colorant in different percentage weight amounts.

16. The method of claim 13, wherein the ink dots formed on the print media have an average diameter of less than about 50 microns.

17. The method of claim 13, wherein the ink drops have an average volume of less than about 12 picoliters.

18. The method of claim 13, wherein the print medium is a textile and the ink drops have an average volume of less than about 40 picoliters.

19. The method of claim 13, wherein the purge image data specifies the deposition of ink dots of each ink type associated with each image scanline on less than one-hundredth of the number of predetermined pixel locations on each image scanline.

20. The method of claim 13, wherein there is a minimum steady state drop purging frequency, $f_{pc}$, that is required to maintain a desired ink drop volume and velocity ejected from the plurality of ink jets for each of the plurality of ink types, c, the print medium is moved the predetermined image length in a print time, $T_p$, the purge image data is constructed so that ink dots for each ink type c are specified for at least $N_{pc}$ predetermined pixel locations on each of the plurality of image scanlines within the predetermined image length, wherein $N_{pc} \geqq f_{pc} T_p$.

21. The method of claim 13 wherein the purge image data is constructed by tiling a purge image matrix that specifies dot locations for at least 100 predetermined pixel locations along 100 image scanlines.

22. A method for maintaining a plurality of ink jets used in a printing apparatus that forms a selected ink image on a print medium by relatively moving the plurality of ink jets and the print medium in a process direction a predetermined image length in a print time $T_p$ while ink drops are ejected by the plurality of ink jets, the printing apparatus forming a selected ink image in response to selected image data specifying the deposition of ink dots at selected predetermined pixel locations on a plurality of image scanlines aligned with and extending in the process direction a predetermined image length on the print medium, wherein there are a plurality, r, of minimum steady state drop purging frequencies, $f_{pr}$, that are required to maintain a desired ink drop volume and velocity ejected from the plurality of ink jets based on a plurality, r, of conditions, the method comprising the steps of:

(a) constructing a plurality, r, of purge image data sets, $I_{pr}$, so that ink dots are specified for at least $N_{pr}$ predetermined pixel locations on each of the plurality of image scanlines within the predetermined image length, wherein $N_{pr} \geqq f_{pr} T_p$;

(b) constructing a purge performance image data set that comprises portions of the plurality of purge image data sets, $I_{pr}$, and test image patterns sensitive to variations in ink drop ejection volume, velocity, or both;

(c) storing the plurality of purge image data sets, $I_{pr}$, and the purge performance image data set in a purge image memory accessible by the printing apparatus;

(d) printing the purge performance image data set to form a purge performance test image;

(e) determining from, at least, the purge performance test image a purge image data set, $I_{ps}$, of the plurality of purge image data sets, $I_{pr}$, that maintains the desired ink drop volume and velocity;

(f) retrieving the purge image data set, $I_{ps}$;

(g) receiving selected image data specifying a selected ink image;

(h) logically combining the purge image data set, $I_{ps}$, and the selected image data to create print image data that specifies the deposition of ink dots at every predetermined pixel location based on the purge image data set, $I_{ps}$, or the selected image data;

(i) printing the print image data on the print medium.

23. The method of claim 22 wherein the printing apparatus further comprises an optical image sensor apparatus, and the determining step (e) further comprises optically sensing the purge performance test image.

24. The method of claim 22 wherein the printing apparatus further comprises a user interface, and the determining step (e) further comprises viewing the purge performance test image and entering user selection data via the user interface.

25. An ink jet printing apparatus for printing a selected ink image on a print medium in the form of ink dots deposited at selected predetermined pixel locations along a plurality of image scanlines aligned with and extending a predetermined image length in a process direction comprising:

(a) an ink jet printhead having a plurality of ink jets supplied with the ink;

(b) apparatus adapted to relatively move the print medium and the ink jet printhead in the process direction while ink drops are ejected by the ink jet printhead;

(c) a memory adapted to store purge image data that specifies the deposition of at least one ink dot on at least one predetermined pixel location on each of the plurality of image scanlines within the predetermined image length; and (d) a controller adapted to receive selected image data specifying the selected image, to retrieve the purge image data, to logically combine the selected image data and the purge image data forming print image data that specifies the deposition of ink dots at every predetermined pixel location based on the purge image data or the selected image data and to output the print image data to the ink jet printhead; thereby causing the selected ink image to be formed on the print medium and the plurality of ink jets to be maintained according to the method of claim 1.

26. The ink jet printing apparatus of claim 25, wherein the ink jet printhead is stationary during the printing of the print image data.

27. The ink jet printing apparatus of claim 25, wherein the print medium is a textile.

28. The ink jet printing apparatus of claim 25, wherein the plurality of ink jets includes at least one jet aligned with each image scanline.

29. The ink jet printing apparatus of claim 25, wherein the image scanlines are located in only a portion of the print medium area along a direction perpendicular to the process direction and the selected ink image is printed on only a portion of the print medium area perpendicular to the process direction.

30. The ink jet printing apparatus of claim 25, further comprising apparatus adapted to position the ink jet printhead at different locations along a direction perpendicular to the process direction.

31. The ink jet printing apparatus of claim 25, wherein the print medium is in the form of a cut sheet and the apparatus adapted to relatively move print medium and the ink jet printhead comprises a circulating surface moving in the process direction on which is mounted the cut sheet and the predetermined image length is substantially equal to the length of the cut sheet in the process direction.

32. The ink jet printing apparatus of claim 25 wherein the controller is further adapted to retrieve and decompress purge image data stored in compressed form.

33. A method for maintaining a plurality of ink jets used in a printing apparatus that forms a selected ink image on a print medium by relatively moving the plurality of ink jets and the print medium in a process direction while ink drops are ejected by the plurality of ink jets, the printing apparatus forming a selected ink image in response to selected image data specifying the deposition of ink dots at selected predetermined pixel locations on a plurality of image scanlines aligned with and extending in the process direction a predetermined image length on the print medium, the method comprising the steps of:

(a) constructing purge image data that specifies the deposition of at least one ink dot on at least one predetermined pixel location on each of the plurality of image scanlines within the predetermined image length;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium and wherein the purge image data specifies a printed purge image that exhibits substantially blue noise spatial frequency characteristics.

34. The method of claim 33, wherein the print medium has an average base optical density and the purge image data specifies a printed purge image that has an average purge image optical density less than about 0.01 OD above the print medium average base optical density.

35. A method for maintaining a plurality of ink jets supplied with a plurality of inks of different types, used in a printing apparatus that forms a selected ink image on a print medium by relatively moving the plurality of ink jets and the print medium in a process direction while ink drops of the different types are ejected by the plurality of ink jets, the printing apparatus forming a selected ink image in response to selected image data specifying the deposition of ink dots of the different types at selected predetermined pixel locations on a plurality of image scanlines aligned with and extending in the process direction a predetermined image length on the print medium, the image scanlines further associated with one or more of the plurality of ink types, the method comprising the steps of:

(a) constructing purge image data that specifies for each scanline, the deposition of at least one ink dot of each ink type associated with that scanline on at least one predetermined pixel location within the predetermined image length;

(b) storing the purge image data in a purge image memory accessible by the printing apparatus;

(c) receiving selected image data specifying a selected ink image;

(d) logically combining the purge image data and the selected image data to create print image data that specifies the deposition of ink dots at every predetermined pixel location based on the purge image data or the selected image data;

(e) printing the print image data on the print medium and wherein the purge image data specifies a printed purge image that exhibits substantially blue noise spatial frequency characteristics.

36. The method of claim 35, wherein the print medium has an average base optical density and the purge image data specifies a printed purge image that has an average purge image optical density less than about 0.01 OD above the print medium average base optical density.

* * * * *